US010228650B2

(12) United States Patent
Hashimoto et al.

(10) Patent No.: US 10,228,650 B2
(45) Date of Patent: Mar. 12, 2019

(54) IMAGE FORMING APPARATUS AND DRUM UNIT THEREOF PROVIDED WITH DRUM CLEANER

(71) Applicant: BROTHER KOGYO KABUSHIKI KAISHA, Nagoya, Aichi (JP)

(72) Inventors: Junichi Hashimoto, Toyohashi (JP); Ryuya Yamazaki, Nagoya (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 68 days.

(21) Appl. No.: 14/672,343

(22) Filed: Mar. 30, 2015

(65) Prior Publication Data

US 2015/0277344 A1 Oct. 1, 2015

(30) Foreign Application Priority Data

Mar. 31, 2014 (JP) ..... 2014-073248

(51) Int. Cl.
*G03G 21/10* (2006.01)
*G03G 21/12* (2006.01)

(52) U.S. Cl.
CPC ..... *G03G 21/105* (2013.01)

(58) Field of Classification Search
CPC combination set(s) only.
See application file for complete search history.

(56) References Cited

U.S. PATENT DOCUMENTS

2010/0247137 A1 9/2010 Akaike et al.
2011/0217069 A1 9/2011 Imai et al.
(Continued)

FOREIGN PATENT DOCUMENTS

JP 2003-029486 A 1/2003
JP 2010-008472 A 1/2010
(Continued)

OTHER PUBLICATIONS

Japanese Office Action dated Dec. 6, 2016 received in related application JP 2014-073248 together with an English language translation.

(Continued)

*Primary Examiner* — Minh Q Phan
(74) *Attorney, Agent, or Firm* — Scully ,Scott, Murphy & Presser, P.C.

(57) ABSTRACT

An image forming apparatus includes: an apparatus body; a photosensitive drum defining an axis extending in a first direction; a support member movable between an inside position and an outside position relative to the apparatus body; a cleaner for removing waste toner from the photosensitive drum; a first conveyer for conveying the waste toner in the first direction; a conveying unit; and a container for storing the waste toner conveyed by the conveying unit. The conveying unit includes a second conveyer for conveying the waste toner conveyed by the first conveyer in a second direction intersecting with the first direction; and a conveying pipe accommodating the second conveyer and connectable to the container. The conveying pipe includes a shutter for opening and closing a conveyer-side opening formed in a downstream end portion of the conveying pipe in the second direction.

20 Claims, 14 Drawing Sheets

(56) References Cited

U.S. PATENT DOCUMENTS

| | | | | |
|---|---|---|---|---|
| 2012/0328325 | A1* | 12/2012 | Sato | G03G 21/1623 399/110 |
| 2014/0037321 | A1 | 2/2014 | Sato | |
| 2014/0334842 | A1 | 11/2014 | Fukuchi et al. | |
| 2015/0147088 | A1* | 5/2015 | Sato | G03G 21/1853 399/110 |

FOREIGN PATENT DOCUMENTS

| | | | |
|---|---|---|---|
| JP | 2010-231113 | A | 10/2010 |
| JP | 2011-186068 | A | 9/2011 |
| JP | 2014-032348 | A | 2/2014 |
| JP | 2014-219599 | A | 11/2014 |

OTHER PUBLICATIONS

Japanese Decision of Rejection dated May 9, 2017 received in related application JP 2014-073248 together with an English language translation.

* cited by examiner

IMAGE FORMING APPARATUS AND DRUM UNIT THEREOF PROVIDED WITH DRUM CLEANER

CROSS REFERENCE TO RELATED APPLICATION

This application claims priority from Japanese Patent Application No. 2014-073248 filed Mar. 31, 2014. The entire content of the priority application is incorporated herein by reference.

TECHNICAL FIELD

The present invention relates to an electrophotographic image forming apparatus and a drum unit attachable to the image forming apparatus.

BACKGROUND

As an electrophotographic image forming apparatus, there is known a so-called tandem-type color printer that includes a plurality of image carriers corresponding to colors of yellow, magenta, cyan, and black respectively.

As such a color printer, Japanese Patent Application Publication No. 2010-8472 discloses an image forming apparatus that includes: a plurality of process cartridges each supporting a photosensitive drum; a frame that supports the process cartridges; and a photosensitive-body waste toner conveying pipe that is configured to convey waste toner from each process cartridge to a waste toner container.

SUMMARY

In this image forming apparatus, the waste toner container is disposed at a front end side (leading end side) in a direction in which an image forming unit is withdrawn (withdrawal direction). Therefore, conceivably, waste toner may spill out of a connecting portion between the waste toner container and the photosensitive-body waste toner conveying pipe during attachment/detachment of the waste toner container, which will result in contamination of a front end portion of the image forming unit in the withdrawal direction.

If the front end portion of the image forming unit is contaminated, the dirty front end portion of the image forming unit would then possibly cause contamination of an area near the image forming apparatus when the image forming unit is pulled out, and would result in lower operability of the image forming unit.

In view of the foregoing, it is an object of the invention to provide an image forming apparatus capable of smoothly moving a supporting member relative to an apparatus body, while suppressing contamination of the support member, and also to provide a drum unit that is smoothly movable relative to the apparatus body.

In order to attain the above and other objects, there is provided an image forming apparatus that may include an apparatus body, a photosensitive drum, a support member, a cleaner, a first conveyer, a conveying unit and a container. The photosensitive drum defines an axis extending in a first direction. The support member is configured to move between an inside position where the support member is inside the apparatus body and an outside position where the support member is outside the apparatus body, the support member moving from the outside position to the inside position in a second direction intersecting with the first direction. The cleaner is configured to remove waste toner from the photosensitive drum. The first conveyer is configured to convey the waste toner removed by the cleaner in the first direction. The conveying unit includes: a second conveyer configured to convey the waste toner conveyed by the first conveyer in the second direction; and a conveying pipe accommodating the second conveyer therein, the conveying pipe extending in the second direction and having a downstream end portion in the second direction, the downstream end portion being formed with a conveyer-side opening, the conveying pipe including a shutter configured to move between an open position where the shutter opens the conveyer-side opening and an closed position where the shutter closes the conveyer-side opening. The container is configured to store the waste toner conveyed by the second conveyer, the downstream end portion of the conveying pipe being connectable to and removable from the container, the conveying pipe connected to the container being in communication with the container through the conveyer-side opening.

According to another aspect of the invention, there is provided a drum unit configured to move between an inside position inside an apparatus body of an image forming apparatus and an outside position outside the apparatus body of the image forming apparatus, the drum unit moving from the outside position to the inside position in a moving direction. The drum unit may include: a photosensitive drum defining an axis extending in a first direction intersecting with the moving direction; a cleaner configured to remove waste toner from the photosensitive drum; a first conveyer configured to convey the waste toner removed by the cleaner in the first direction; and a conveying unit. The conveying unit includes: a second conveyer configured to convey the waste toner conveyed by the first conveyer in the moving direction; and a conveying pipe accommodating the second conveyer therein, the conveying pipe extending in the moving direction and having a downstream end portion in the moving direction, the downstream end portion being formed with a conveyer-side opening, the conveying pipe including a shutter configured to move between an open position where the shutter opens the conveyer-side opening and an closed position where the shutter closes the conveyer-side opening.

According to still another aspect of the invention, there is provided an image forming apparatus that may include an apparatus body, a photosensitive drum, a support member, a cleaner, a first conveyer, a second conveyer and a container. The photosensitive drum defines an axis extending in a first direction. The support member supports the photosensitive drum and is configured to move between an inside position where the support member is inside the apparatus body and an outside position where the support member is outside the apparatus body, the support member moving from the outside position to the inside position in a second direction intersecting with the first direction. The cleaner is supported on the support member and is configured to remove waste toner from the photosensitive drum. The first conveyer is supported on the support member and is configured to convey the waste toner removed by the cleaner in the first direction. The second conveyer is supported on the support member and is configured to convey the waste toner conveyed by the first conveyer in the second direction, the second conveyer extending in the second direction and having a downstream end portion in the second direction in which a conveyer-side opening is formed, the second conveyer including a shutter configured to move between an open position where the shutter opens the conveyer-side opening and an closed position where the shutter closes the conveyer-side opening. The container is configured to store the waste toner conveyed by the second conveyer, the downstream end portion of the second conveyer being connectable to and removable from the container, the second conveyer connected to the container being in communication with the container through the conveyer-side opening.

DETAILED DESCRIPTION

1. Overall Structure of the Printer

Figure 1:
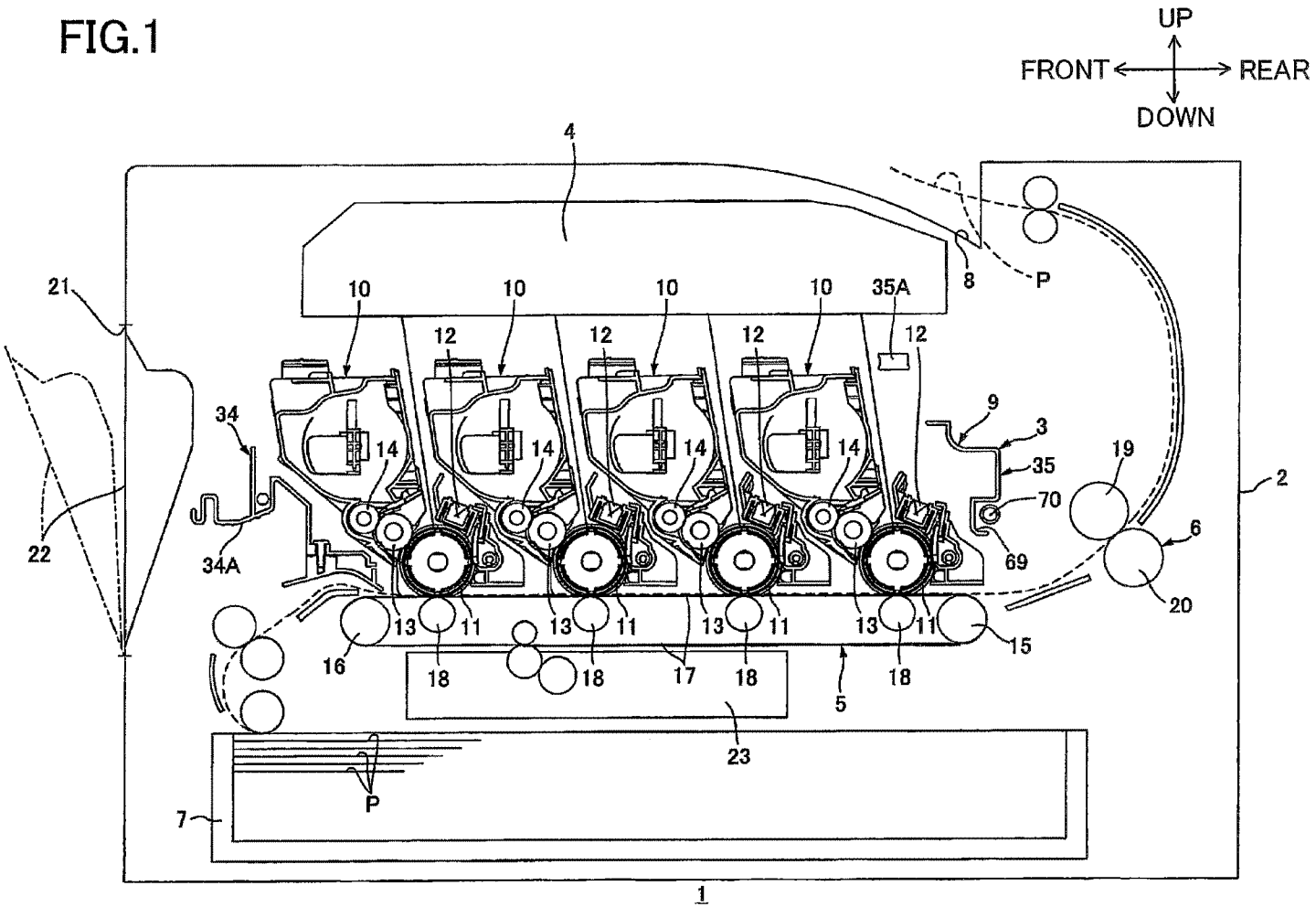
FIG. 1 is a central cross-sectional view of a printer as an example of an image forming apparatus according to an embodiment of the invention, the printer including a drum unit.

A printer 1 according to an embodiment of the invention will be described with reference to FIGS. 1 through 11B.

The printer 1 as an example of an image forming apparatus of the invention is a horizontal direct tandem-type color laser printer.

The printer 1 includes an apparatus body 2, a process unit 3, a scanner unit 4, a transfer unit 5, and a fixing unit 6.

The apparatus body 2 is formed in a substantially box shape. The apparatus body 2 includes an opening 21, a front cover 22, a sheet feeding tray 7, and a sheet discharge tray 8.

The opening 21 is formed in a front end portion of the apparatus body 2 to penetrate therethrough in a front-rear direction. The opening 21 permits communication between inside and outside of the apparatus body 2 so that the process unit 3 can be inserted through the opening 21.

The front cover 22 is provided on the front end portion of the apparatus body 2. The front cover 22 has a substantially flat plate-like shape and extends in an up-down direction. The front cover 22 is supported by a front wall of the apparatus body 2 so as to be capable of pivotally moving about a lower end of the front cover 22. The front cover 22 is configured to open and close the opening 21.

The sheet feeding tray 7 is disposed at a bottom end portion of the apparatus body 2. The sheet feeding tray 7 is adapted to accommodate sheets P (an example of a transfer medium of the invention).

The sheet discharge tray 8 is formed on an upper wall of the apparatus body 2. The sheet discharge tray 8 is recessed downward from an upper surface of the apparatus body 2 for receiving the sheets P.

The process unit 3 is disposed in a center region of the apparatus body 2. The process unit 3 is movable, through the opening 21, between an inside position in which the process unit 3 is accommodated in the apparatus body 2 and an outside position at which the process unit 3 is withdrawn from the apparatus body 2 in the front-rear direction. The inside position is examples of a contact position and an inside position of the invention. The outside position is an example of an outside position of the invention. The front-rear direction is an example of a second direction of the invention.

The process unit 3 includes a drum unit 9 (as an example of a support member of the invention) and a plurality of (four) developing cartridges 10.

The drum unit 9 includes a plurality of (four) photosensitive drums 11 and a plurality of (four) scorotron-type chargers 12.

Each of the photosensitive drums 11 is rotatably supported by a lower end portion of the drum unit 9. The four photosensitive drums 11 respectively correspond to four colors of yellow, magenta, cyan, and black. The photosensitive drums 11 are arranged in parallel at intervals in the front-rear direction in an order of yellow, magenta, cyan, and black from the front to the rear. Each photosensitive drum 11 has a substantially cylindrical shape extending in a left-right direction and defines an axis extending in the left-right direction (an example of a first direction of the invention).

The four scorotron-type chargers 12 respectively correspond to the four photosensitive drums 11, and are disposed diagonally upward and rearward of the respective photosensitive drums 11 with a gap therebetween.

The four developing cartridges 10 respectively correspond to the four photosensitive drums 11, and are disposed generally upward of the corresponding photosensitive drums 11. Each developing cartridge 10 includes a developing roller 13 and a supply roller 14. Further, each developing cartridge 10 accommodates toner of a corresponding color in a space positioned above the developing roller 13 and the supply roller 14.

The developing roller 13 is rotatably supported by a lower end portion of the corresponding developing cartridge 10 and is exposed rearward therefrom. The developing roller 13 is contact with an upper-front end portion of the corresponding photosensitive drum 11.

The supply roller 14 is disposed frontward of and above the developing roller 13. The supply roller 14 contacts an upper-front end portion of the developing roller 13.

The scanner unit 4 is disposed in an upper end portion of the apparatus body 2. As indicated by solid lines in FIG. 1, the scanner unit 4 is configured to emit laser beams based on image data toward the respective photosensitive drums 11 to expose surfaces of the respective photosensitive drums 11.

The transfer unit 5 is disposed below the process unit 3. The transfer unit 5 includes a drive roller 15, a driven roller 16, a conveyor belt 17, and a plurality of (four) transfer rollers 18.

The drive roller 15 is disposed on a rear end portion of the transfer unit 5.

The driven roller 16 is disposed on a front end portion of the transfer unit 5 and is separated from the drive roller 15 in the front-rear direction. That is, the driven roller 16 is positioned frontward of the drive roller 15.

The conveyor belt 17 is mounted over the drive roller 15 and the driven roller 16 such that an upper portion of the conveyor belt 17 contacts each of the photosensitive drums 11. The conveyor belt 17 is configured to circularly move such that the upper portion thereof moves from the front side toward the rear side by the rotation of the drive roller 15 and the following rotation of the driven roller 16.

The four transfer rollers 18 respectively correspond to the four photosensitive drums 11. The transfer rollers 18 are disposed below the corresponding photosensitive drums 11 with the upper portion of the conveyor belt 17 interposed therebetween.

The fixing unit 6 is disposed rearward of the transfer unit 5. The fixing unit 6 includes a heating roller 19 and a pressing roller 20 that contacts the heating roller 19.

When the printer 1 starts an image forming operation, the scorotron-type chargers 12 uniformly charge the surfaces of the respective photosensitive drums 11. Subsequently, the scanner unit 4 exposes the surfaces of the respective photosensitive drums 11. An electrostatic latent image based on the image data is thus formed on the surface of each photosensitive drum 11.

The supply roller 14 supplies the toner inside the developing cartridge 10 to the corresponding developing roller 13. At this time, the toner is positively tribo-charged between the developing roller 13 and the supply roller 14, and is carried on a surface of the developing roller 13.

The developing roller 13 then supplies the toner carried thereon to the electrostatic latent image formed on the surface of the corresponding photosensitive drum 11, by which process a toner image is carried on the surface of the photosensitive drum 11.

In the meantime, the sheets P are conveyed forward and upward from the sheet feeding tray 7 by rotations of various rollers, are then conveyed upward and rearward while making a U-turn, and are subsequently fed one by one between the yellow photosensitive drum 11 and the conveyor belt 17 at a predetermined timing. Each sheet P is then conveyed frontward by the conveyor belt 17. The toner image on each photosensitive drum 11 is transferred onto the sheet P while the sheet P passes between each photosensitive drum 11 and the corresponding transfer roller 18.

Subsequently, the sheet P is applied with heat and pressure when passing between the heating roller 19 and the pressing roller 20. At this time, the toner image on the sheet P is thermally-fixed to the sheet P. The sheet P is finally discharged onto the sheet discharge tray 8.

2. Detailed Structure of the Drum Unit

Figure 2:
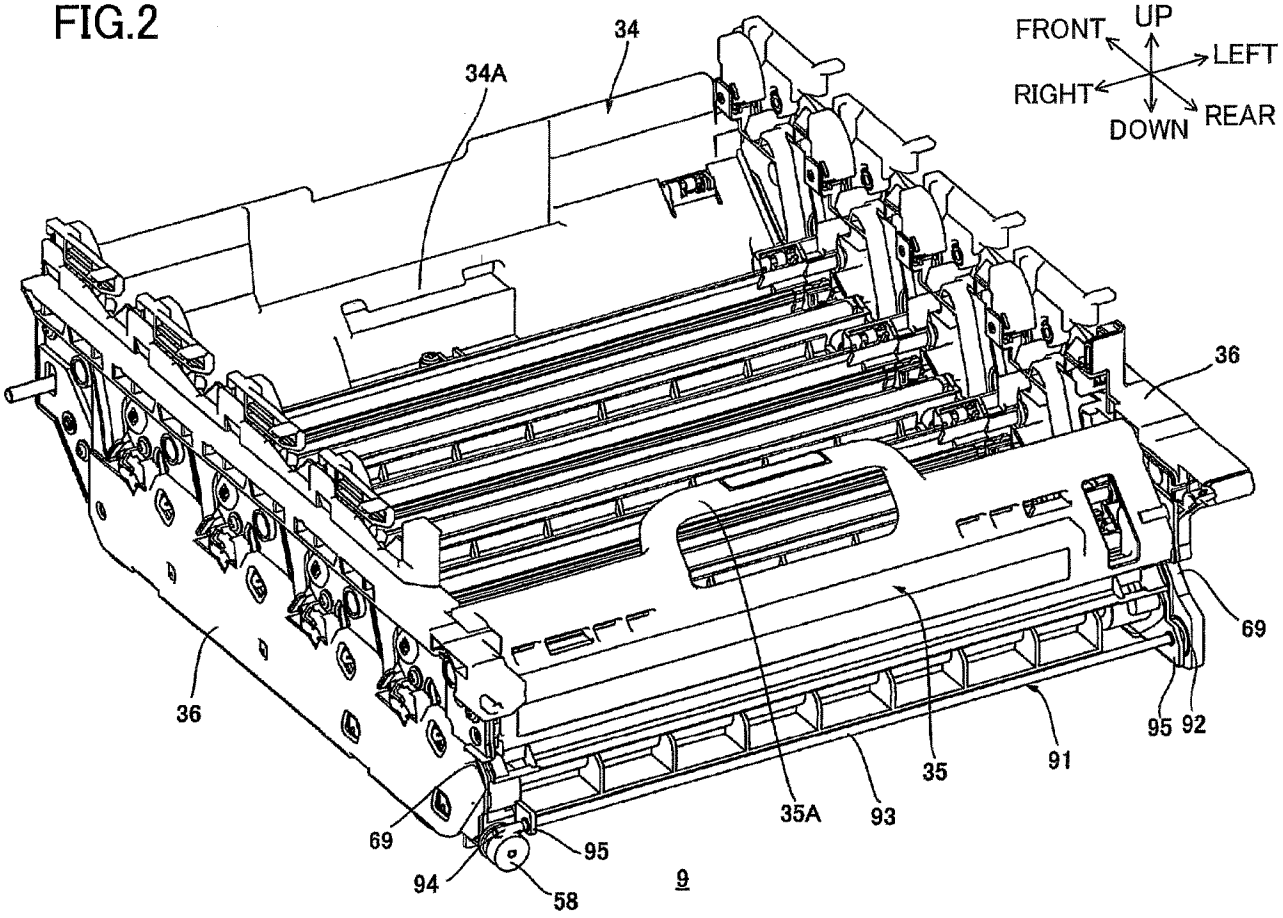
FIG. 2 is a perspective view of the drum unit according to the embodiment when viewed from rightward and rearward thereof.
Figure 4:
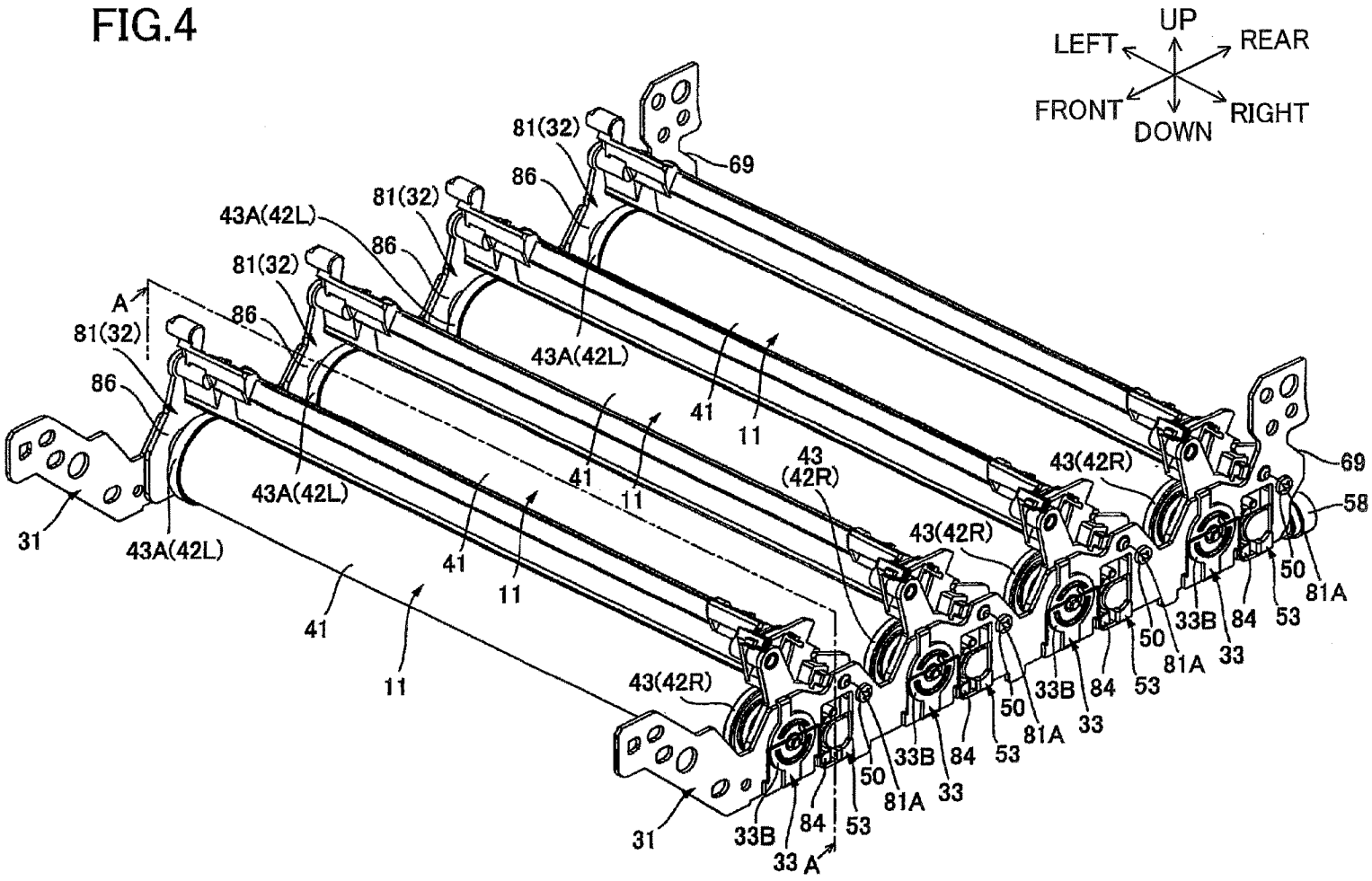
FIG. 4 is a perspective view showing components of the drum unit according to the embodiment in an assembled state when viewed from rightward and frontward thereof, wherein a front plate, a rear plate and outer plates are removed from the drum unit.

As illustrated in FIGS. 2 and 4, the drum unit 9 has a substantially rectangular frame-like shape in a plan view. The drum unit 9 includes a pair of inner plates 31, the four photosensitive drums 11, a plurality of (four pairs of) bearing members 33, a drum cleaning unit 30, a rotation member 91, a front plate 34, a rear plate 35, and a pair of outer plates 36. The front plate 34, rear plate 35 and outer plates 36 correspond to a support frame of the invention.

(1) Inner Plates

Figure 5:
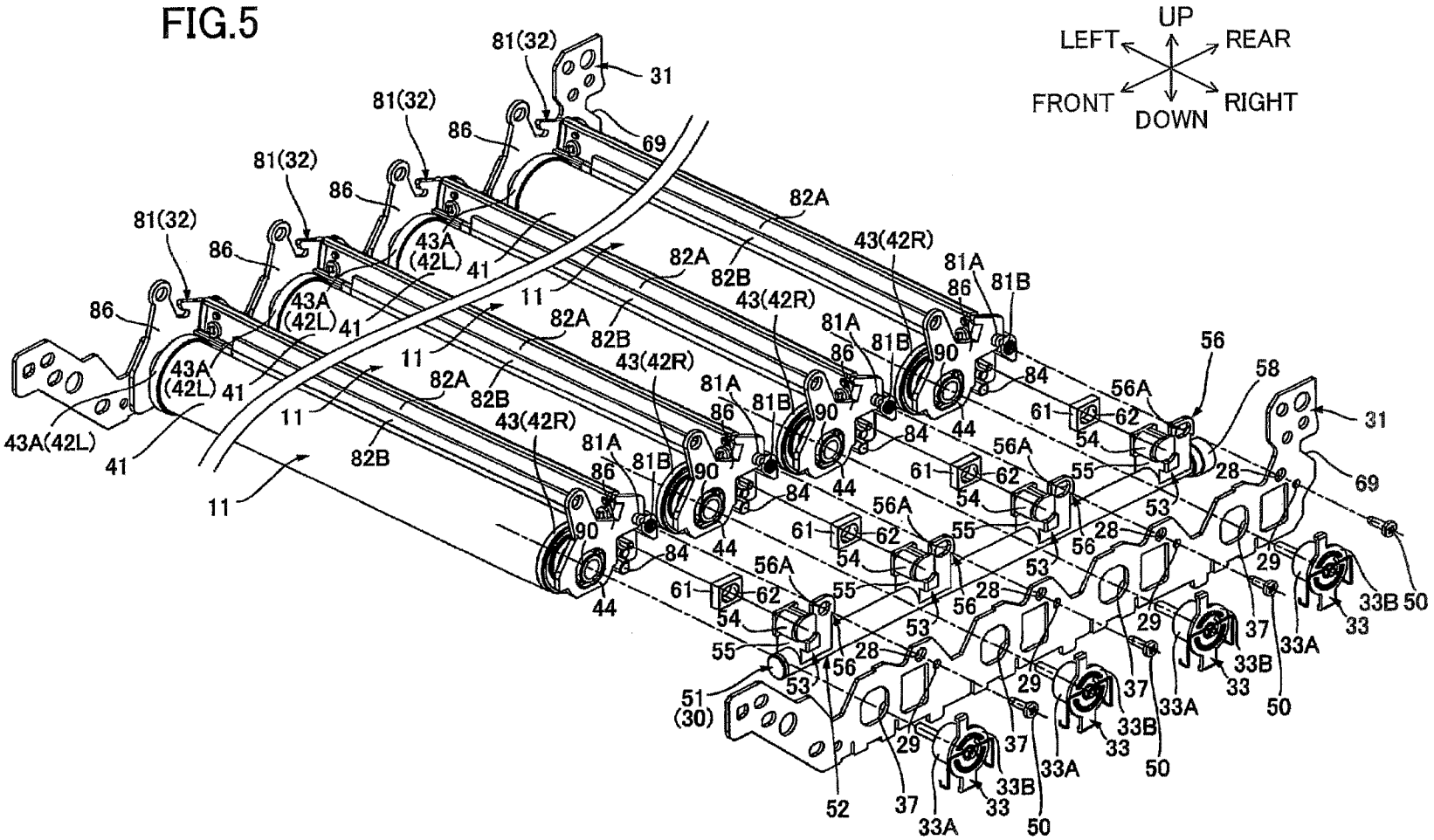
FIG. 5 is an exploded perspective view showing the components of the drum unit according to the embodiment when viewed from rightward and frontward thereof, wherein the front plate, the rear plate and the outer plates are removed from the drum unit.

As illustrated in FIG. 4, each of the pair of inner plates 31 is disposed at both end portions of the drum unit 9 in the left-right direction such that the inner plates 31 are separated from each other in the left-right direction. Each of the pair of inner plates 31 substantially has a rectangular flat plate-like shape in a side view and is elongated in the front-rear direction. The pair of inner plates 31 is manufactured by pressing a metal plate using the same pressing mold. The inner plates 31 have therefore the same shape as each other. As illustrated in FIG. 5, each inner plate 31 includes a plurality of (four) penetration holes 37, a plurality of (four) boss insertion holes 28, a plurality of (four) screw insertion holes 29, and a notch portion 69.

The four penetration holes 37 are arranged at the same interval as each other in the front-rear direction. The four penetration holes 37 are disposed to correspond to the four photosensitive drums 11 respectively. Each of the penetration holes 37 has a substantially circular shape in a side view.

The four boss insertion holes 28 are disposed rearward and upward of the respective penetration holes 37. Each of the boss insertion holes 28 penetrates the corresponding inner plate 31 in the left-right direction. Each boss insertion holes 28 has a substantially elongated hole shape extending in the front-rear direction in a side view.

The four screw insertion holes 29 are disposed rearward and downward of the respective boss insertion holes 28. Each of the screw insertion holes 29 penetrates the corresponding inner plate 31 in the left-right direction, and has a substantially circular shape in a side view.

The notch portion 69 is provided at a rear end of the corresponding inner plate 31. The notch portion 69 is provided by notching (cutting out) a rear edge of the inner plate 31 frontward. The notch portion 69 has a substantially V-shape in a side view that is open rearward.

(2) Photosensitive Drums and Bearing Members

Figure 6A:
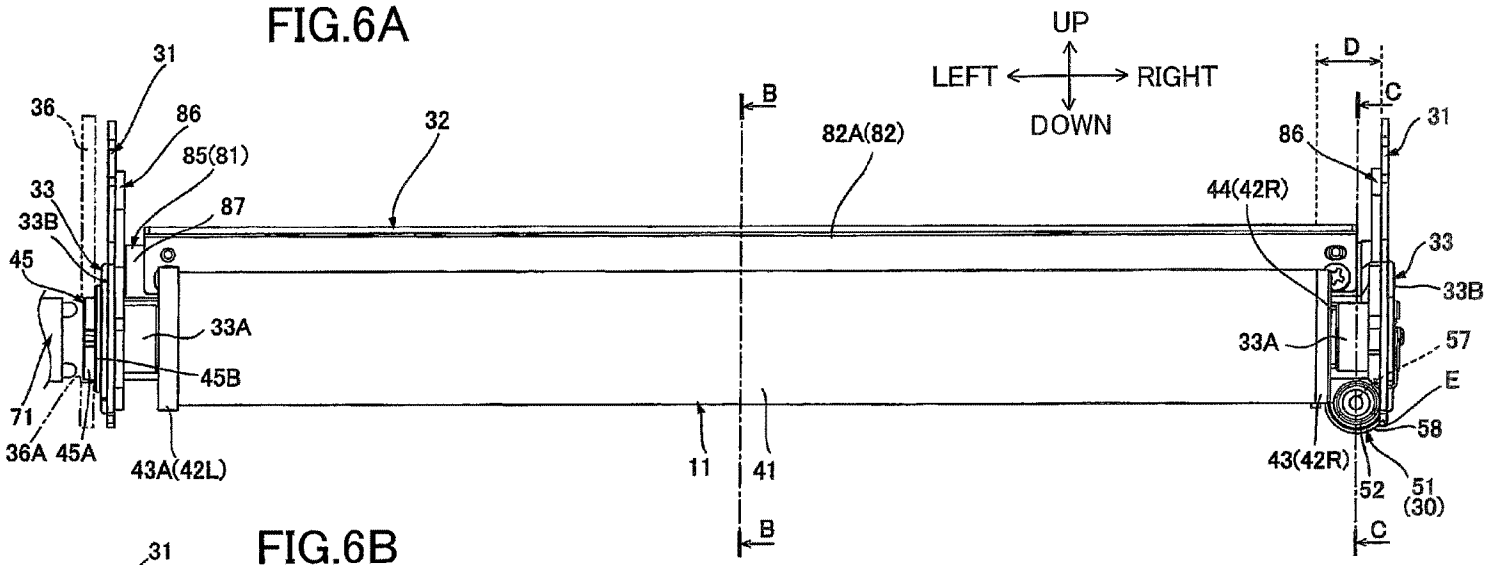
FIG. 6A is a front view of the drum unit according to the embodiment shown in FIG. 4.

As illustrated in FIGS. 5 and 6A, each of the photosensitive drums 11 includes a drum body 41, a pair of flange members 42, and a drum coupling 45.

The drum body 41 is disposed between the pair of inner plates 31. The drum body 41 is a metal pipe that extends in the left-right direction and has a substantially cylindrical shape. The drum body 41 has an outer peripheral surface on which a photosensitive layer is provided. Both ends of the drum body 41 in the left-right direction are respectively disposed inward of the inner plates 31 in the left-right direction with a gap D defined therebetween.

Each of the pair of flange members 42 is fitted to each of the both right and left ends of the drum body 41 so as not to be rotatable relative thereto. Furthermore, in the following description, the left flange member 42 may be referred to as a left flange member 42L and the right flange member 42 may be referred to as a right flange member 42R, whenever necessary. Each flange member 42 includes a large-diameter portion 43 and a small-diameter portion 44.

The large-diameter portion 43 is disposed at an inner end of the flange member 42 in the left-right direction. The large-diameter portion 43 has a substantially cylindrical shape with its outer end in the left-right direction closed. The large-diameter portion 43 has an outer diameter substantially equal to the inner diameter of the drum body 41. The large-diameter portion 43 is inserted into the drum body 41 such that the outer end in the left-right direction is exposed to outside of the drum body 41 in the left-right direction. The large-diameter portion 43 of the left flange member 42L includes a gear part 43A.

The gear part 43A is provided on a left end of the large-diameter portion 43 of the left flange member 42L. The gear part 43A has a substantially disk-like shape having a thickness in the left-right direction. Gear teeth are formed on an entire peripheral surface of the gear part 43A.

The small-diameter portion 44 protrudes outward in the left-right direction from an outer wall of the large-diameter portion 43 in the left-right direction. The small-diameter portion 44 has a substantially cylindrical shape and is coaxially arranged with the large-diameter portion 43 to share the same central axis with the large-diameter portion 43. The small-diameter portion 44 has an outer diameter smaller than the outer diameter of the large-diameter portion 43.

The drum coupling 45 is disposed on a left end portion of the photosensitive drum 11. The drum coupling 45 includes a coupling portion 45A and a flange 45B.

The coupling portion 45A constitutes a left end of the drum coupling 45 and is positioned leftward (outward in the left-right direction) of the left inner plate 31. The coupling portion 45A has a substantially disk shape whose diameter is larger than the outer diameter of the small-diameter portion 44 of the left flange member 42L. The coupling portion 45A is configured to be fitted to a corresponding body coupling 71 provided at the apparatus body 2 so as not to be rotatable relative to the body coupling 71.

The flange 45B protrudes radially outward from an outer peripheral surface of a right end of the coupling portion 45A. The flange 45B extends in a circumferential direction of the coupling portion 45A and has a substantially annular shape. The flange 45B is disposed between a peripheral edge portion of a penetration hole 36A (described later) of the left outer plate 36 and the left inner plate 31. With this structure, the drum coupling 45 is restricted from coming off leftward from the small-diameter portion 44 of the left flange member 42L.

The drum coupling 45 further includes a shaft portion (not illustrated) that extends rightward from a right surface of the coupling portion 45A. The shaft portion of the drum coupling 45 is fitted to the small-diameter portion 44 of the left flange member 42L such that the drum coupling 45 is incapable of rotating relative to the small-diameter portion 44 of the left flange member 42L. The drum coupling 45 is separable from the small-diameter portion 44 of the left flange member 42L.

The plurality of (four pairs) bearing member 33 are disposed to correspond to the four photosensitive drums 11, respectively. Each pair of the bearing members 33 supports each of both ends of the corresponding photosensitive drum 11 in the left-right direction. Each bearing member 33 includes a cylindrical portion 33A and a flange 33B.

The cylindrical portion 33A has a substantially cylindrical shape that extends in the left-right direction. The cylindrical portion 33A has an inner diameter substantially equal to the outer diameter of the small-diameter portion 44 of the flange member 42. The cylindrical portion 33A has an outer diameter substantially equal to a diameter of an inscribed circle that is inscribed in a plurality of flat surfaces defining the penetration hole 37 of the inner plate 31. The cylindrical portion 33A is fitted to the small-diameter portion 44 of the flange member 42 from outside in the radial direction such that the cylindrical portion 33A is rotatable relative to the small-diameter portion 44 of the flange member 42. The cylindrical portion 33A is fitted to the corresponding penetration hole 37 of each inner plate 31 and to an insertion hole 90 of a wall portion 86 of the corresponding cleaner frame 81 (described later, see FIG. 5).

The flange 33B protrudes radially outward from an outer peripheral surface of an outer end of the cylindrical portion 33A in the left-right direction. The flange 33B extends in a circumferential direction of the cylindrical portion 33A to form a substantially annular shape. The flange 33B contacts the outer surface of the corresponding inner plate 31 from outside in the left-right direction.

(3) Drum Cleaning Unit

The drum cleaning unit 30 includes a plurality of (four) drum cleaners 32, a waste toner conveyer 51 (as an example of a conveying unit of the invention), and a plurality of (four) seal members 61.

(3-1) Drum Cleaner

Figure 6B:
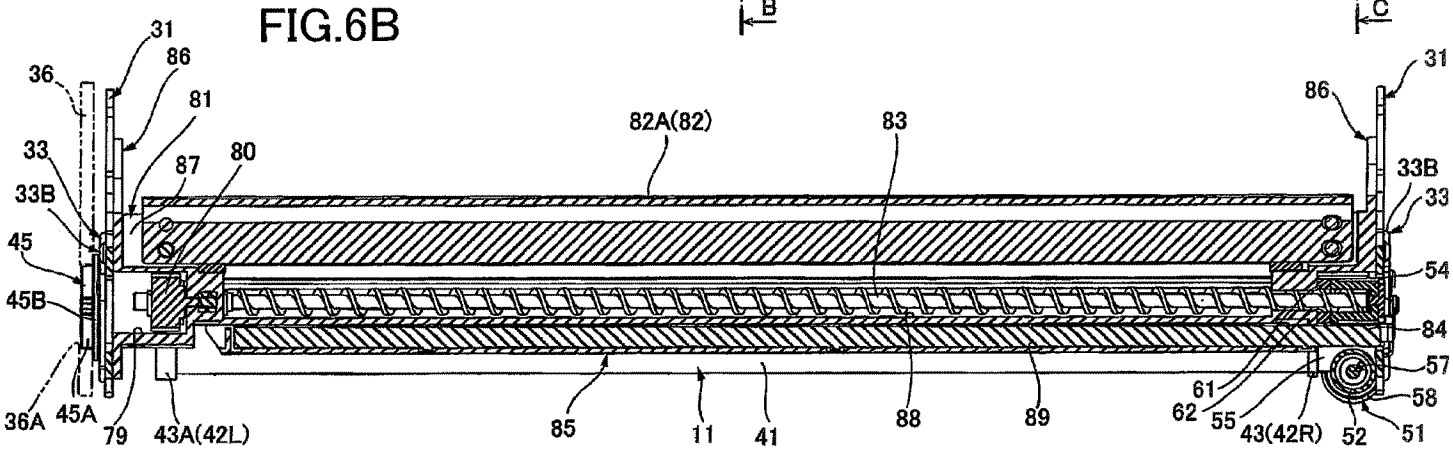
FIG. 6B is a cross-sectional view of the drum unit according to the embodiment taken along a plane A-A shown in FIG. 4.
Figure 7A:
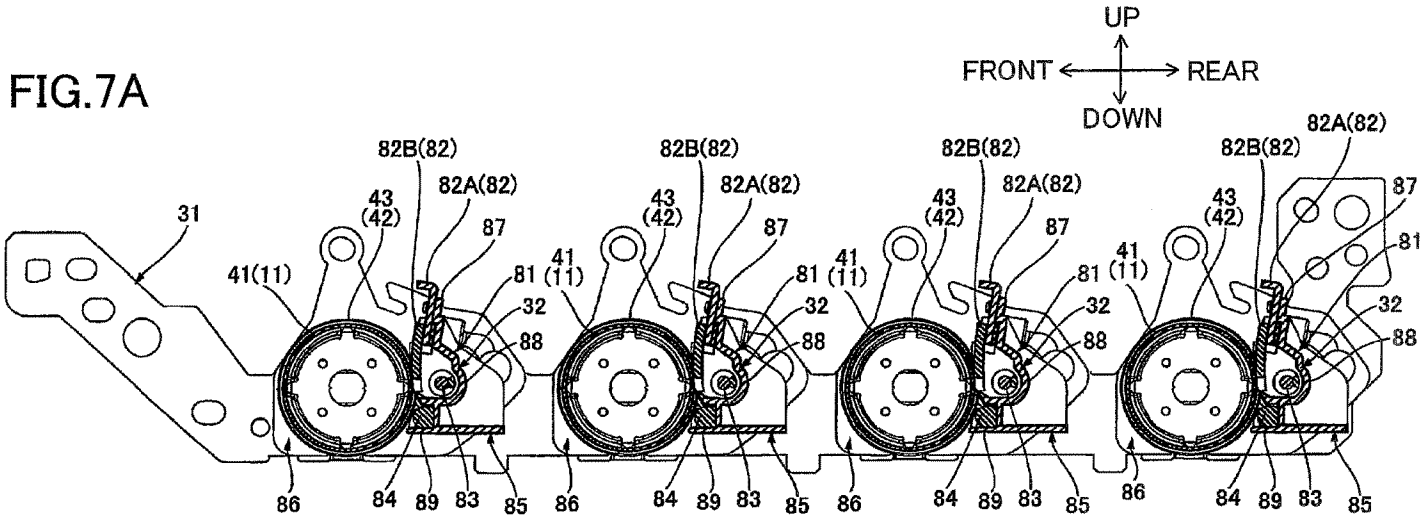
FIG. 7A is a cross-sectional view of the drum unit according to the embodiment taken along a plane B-B shown in FIG. 6A.

As illustrated in FIGS. 6B and 7A, the four drum cleaners 32 correspond to the respective photosensitive drums 11 and are disposed rearward of the corresponding photosensitive drums 11. Each drum cleaner 32 includes the cleaner frame 81, a cleaning blade 82 (an example of a cleaner of the invention), a first screw 83 (an example of a first conveyer of the invention), and a neutralizing member 84.

The cleaner frame 81 includes a main body 85, a pair of wall portions 86, a pair of bosses 81A (see FIG. 5), and a pair of screw holes 81B (see FIG. 5).

The main body 85 constitutes a rear end portion of the cleaner frame 81. The main body 85 has a substantially rectangular cylindrical shape extending in the left-right direction, and is closed at both ends thereof in the left-right direction. The main body 85 includes a blade support portion 87, a waste toner conveying portion 88, a gear accommodation portion 79, and a neutralizing member support portion 89.

The blade support portion 87 is disposed at an upper end of the main body 85. The blade support portion 87 has a substantially plate shape extending in the left-right direction.

The waste toner conveying portion 88 is disposed below the blade support portion 87. The waste toner conveying portion 88 has a substantially semi-cylindrical shape extending in the left-right direction, with its left end closed and with its right end and front end opened. The waste toner conveying portion 88 has an upper end that is continuous to a lower end of the blade support portion 87.

The gear accommodation portion 79 is disposed leftward of the waste toner conveying portion 88. The gear accommodation portion 79 has a substantially semi-cylindrical shape extending in the left-right direction, with its both right and left ends closed and with its front end opened.

The neutralizing member support portion 89 is disposed below the waste toner conveying portion 88. The neutralizing member support portion 89 has a substantially rectangular cylindrical shape extending in the left-right direction and has a front end that is opened. The upper end of the neutralizing member support portion 89 is continuous to the lower end of the waste toner conveying portion 88.

Each of the pair of wall portions 86 constitute each of both ends of the cleaner frame 81 in the left-right direction. Each wall portion 86 has a substantially plate-like shape and extends forward from each of the left and right ends of the main body 85. The wall portions 86 respectively contact the inner surfaces of the inner plates 31. As illustrated in FIG. 5, each wall portion 86 includes the insertion hole 90.

The insertion hole 90 is formed at a position substantially center in the wall portion 86. The insertion hole 90 has a substantially circular shape in a side view. The insertion hole 90 is positioned to be coincident with the corresponding penetration hole 37 of the inner plate 31 when projected in the left-right direction.

Each of the pair of bosses 81A is disposed at each of the both ends of the cleaner frame 81 in the left-right direction. Each boss 81A has a substantially columnar shape and protrudes outward from the outer surface of the main body 85 in the left-right direction. Each boss 81A is fitted into the corresponding boss insertion hole 28 of each inner plate 31.

Each of the pair of screw holes 81B is disposed rearward and downward of each of the pair of boss 81A. Each screw hole 81B has a substantially circular shape in a side view and is recessed inward in the left-right direction from the outer surface of the main body 85 in the left-right direction.

The cleaning blade 82 includes a support member 82A and a blade body 82B.

The support member 82A is formed of a metal and has a substantially plate shape extending in the left-right direction. The support member 82A is fixed to the blade support portion 87 of the cleaner frame 81.

The blade body 82B is formed of an elastic member such as rubber and has a substantially plate shape that extends in the left-right direction. The blade body 82B has an upper end portion that is fixed to the support member 82A. The blade body 82B has a lower end portion that faces the open front end of the waste toner conveying portion 88 so as to cover an upper-half portion of the waste toner conveying portion 88. Further, the lower end portion of the blade body 82B is, while being curved rearward, in contact with the rear end portion of the drum body 41 of the corresponding photosensitive drum 11.

The first screw 83 is disposed inside the waste toner conveying portion 88. The first screw 83 is an auger screw that extends in the left-right direction. The first screw 83 has a left end portion that is rotatably supported by a wall between the gear accommodation portion 79 and the waste toner conveying portion 88 (see FIG. 7B). The left end portion of the first screw 83 penetrates the gear accommodation portion 79 and the waste toner conveying portion 88 and is disposed inside the gear accommodation portion 79. The first screw 83 includes a first screw gear 80.

The first screw gear 80 is supported by the left end portion of the first screw 83 so as not to rotate relative to the first screw 83 within the gear accommodation portion 79. The first screw gear 80 has a substantially columnar shape extending in the left-right direction, and gear teeth are formed on an entire peripheral surface of the first screw gear 80. The first screw gear 80 engages with the large-diameter portion 43 (gear part 43A) of the left flange member 42L of the corresponding photosensitive drum 11 (see FIG. 8).

The neutralizing member 84 is fixedly provided in the neutralizing member support portion 89. The neutralizing member 84 has a semi-columnar shape that extends in the left-right direction. In a side view, the neutralizing member 84 has a substantially arcuate shaped front surface with a central portion thereof in the up-down direction protruding forward. The front surface of the neutralizing member 84 has a center of curvature A1 that is positioned frontward of a rotation center A2 of the corresponding first screw 83 (see FIG. 7B). In other words, the rotation center A2 of the first screw 83 is positioned opposite to the corresponding photosensitive drum 11 with respect to the center of curvature A1 of the front surface of the corresponding neutralizing member 84 in the front-rear direction. The neutralizing member 84 is configured to expose the surface of the corresponding photosensitive drum 11, from which the toner image has been transferred to the sheet P, before the corresponding cleaning blade 82 removes extraneous matter. The neutralizing member 84 thus serves to reduce charges of the surface of the corresponding photosensitive drum 11.

(3-2) Waste Toner Conveyer and Seal Members

As illustrated in FIGS. 5 and 6A, the waste toner conveyer 51 is disposed in the gap D between the drum body 41 of each photosensitive drum 11 and the right inner plate 31. The waste toner conveyer 51 includes a conveying pipe 52, a plurality of (four) connection portions 53, a second screw 57 (an example of a second conveyer of the invention; see FIGS. 6B and 7B), and a second screw gear 58.

The conveying pipe 52 has a substantially cylindrical shape extending in the front-rear direction with its front and rear ends closed.

Figure 9A:
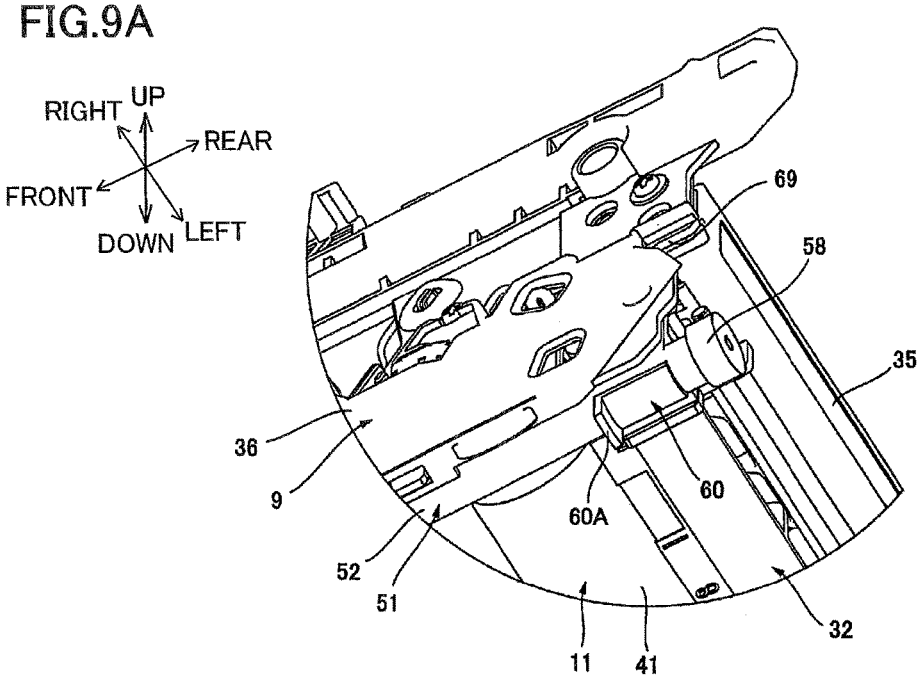
FIG. 9A is an explanatory view explaining movement of a shutter of the conveying pipe according to the embodiment shown in FIG. 7B, wherein the shutter is in a closed position.
Figure 9B:
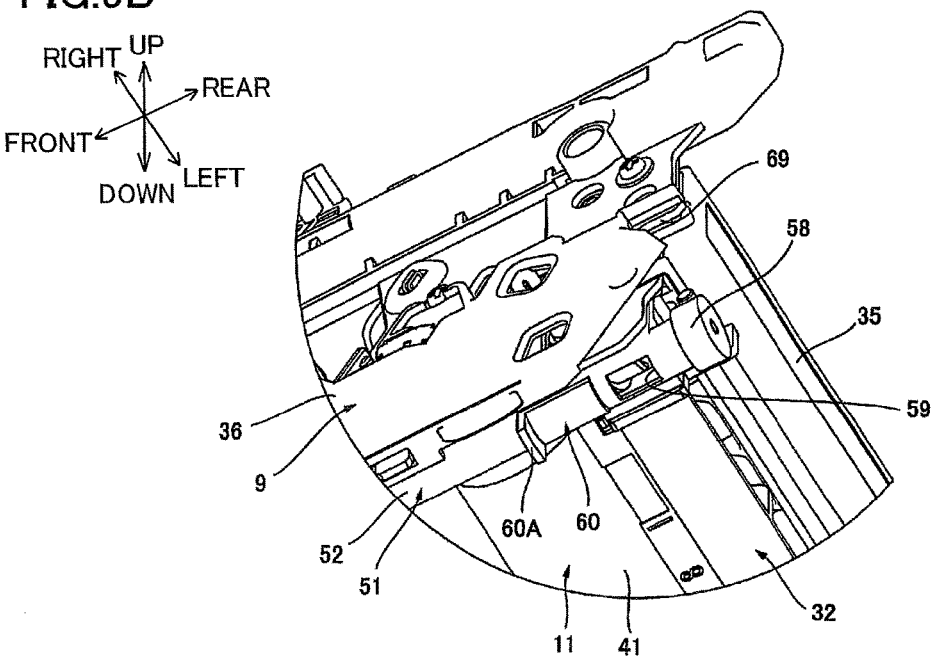
FIG. 9B is an explanatory view explaining movement of the shutter of the conveying pipe according to the embodiment shown in FIG. 7B, wherein the shutter is in an open position.

The conveying pipe 52 is disposed higher than a lower edge E of the inner plate 31 in the up-down direction. When projected in the up-down direction, the conveying pipe 52 overlaps the small-diameter portion 44 of the right flange member 42R and the right end portion of the neutralizing member 84. Further, when projected in the left-right direction, an upper half of the conveying pipe 52 overlaps the lower end portion of the drum body 41 of the corresponding photosensitive drum 11. As illustrated in FIGS. 9A and 9B, the conveying pipe 52 includes an opening 59 (an example of a conveyer-side opening of the invention) and a shutter 60 (an example of a shutter of the invention).

The opening 59 is formed in a rear end portion of the conveying pipe 52. The opening 59 has a substantially rectangular shape in a bottom view and penetrates a lower peripheral wall of the conveying pipe 52 in the up-down direction.

The shutter 60 is also provided on the rear end portion of the conveying pipe 52. The shutter 60 has a substantially rectangular plate-like shape extending in the front-rear direction in a bottom view, with both left and right ends thereof curved upward in conformance with the peripheral surface of the conveying pipe 52. The shutter 60 is configured to move in the front-rear direction between a closed position (see FIG. 9A) where the shutter 60 closes the opening 59 and an open position (see FIG. 9B) where the shutter 60 opens the opening 59. The shutter 60 is normally biased toward the closed position by a biasing member (not illustrated). The shutter 60 includes a contact rib 60A an example of a second engaging portion of the invention.

The contact rib 60A protrudes downward from a front end of the shutter 60. The contact rib 60A has a substantially flat plate shape that extends in the left-right direction.

As illustrated in FIG. 5, the four connection portions 53 are disposed on an upper end portion of the conveying pipe 52 and are spaced away from one another in the front-rear direction. The four connection portions 53 are provided to respectively correspond to the four drum cleaners 32. Each connection portion 53 includes an insertion portion 54, a communication portion 55, and a fixed portion 56.

As illustrated in FIGS. 5 and 6B, the insertion portion 54 constitutes an upper-front end portion of each connection portion 53. The insertion portion 54 has a substantially cylindrical shape extending in the left-right direction, and has a left end that is opened and a right end that is closed. The insertion portion 54 is connected to the right end portion of the waste toner conveying portion 88 of the drum cleaner 32 via the corresponding seal member 61 so as to close the right end portion of the waste toner conveying portion 88. The right end of the first screw 83 is inserted into the insertion portion 54.

Figure 7B:
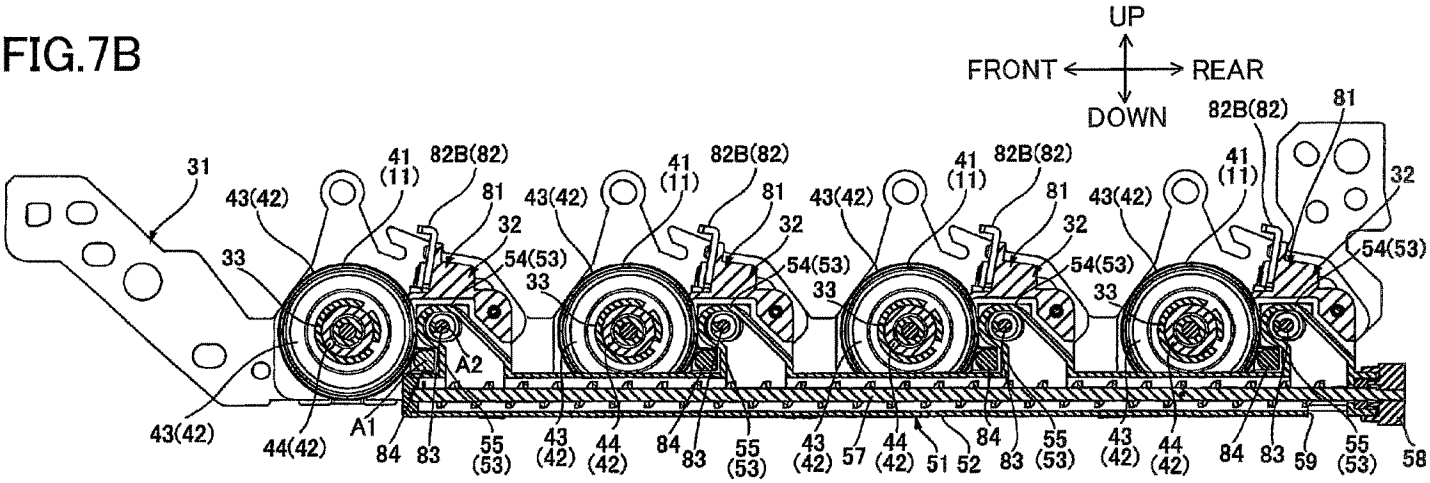
FIG. 7B is a cross-sectional view of the drum unit according to the embodiment taken along a plane C-C shown in FIG. 6A, the drum unit including a first screw, a second screw and a conveying pipe.

As illustrated in FIGS. 5 and 7B, the communication portion 55 is provided rearward of the neutralizing member 84 and at a position downward and rearward of the insertion portion 54. The communication portion 55 has a substantially rectangular cylindrical shape that extends in the up-down direction. The communication portion 55 has an upper-front end portion connected to a lower-rear end portion of the insertion portion 54 to be in communication therewith. The communication portion 55 has a lower end portion connected to the upper end portion of the conveying pipe 52 to be in communication therewith.

As illustrated in FIG. 5, the fixed portion 56 constitutes an upper-rear end portion of the connection portion 53. The fixed portion 56 has a substantially rectangular plate shape in aside view and extends upward from a right end portion of the communication portion 55. The fixed portion 56 includes a screw insertion hole 56A.

The screw insertion hole 56A is formed in a center portion of the fixed portion 56 to penetrate therethrough in the left-right direction. The screw insertion hole 56A of the foremost connection portion 53 has a substantially circular shape in a side view. The screw insertion holes 56A of the connection portions 53 other than the foremost connection portion 53 are in a form of substantially elongated hole in a side view that is elongated in the front-rear direction. The screw insertion hole 56A faces the corresponding screw insertion hole 29 of the right inner plate 31 and the screw hole 81B of the corresponding cleaner frame 81 in the left-right direction. The fixed portion 56 is fixed to the right wall of the corresponding cleaner frame 81 along with the right inner plate 31 by threading the screw 50 into the corresponding screw hole 81B of the cleaner frame 81 via the screw insertion hole 29 of the right inner plate 31 and the screw insertion hole 56A of the fixed portion 56.

Since the foremost connection portion 53 is formed with the substantially circular-shaped screw insertion hole 56A in a side view, the waste toner conveyer 51 is restricted from moving relative to the corresponding (foremost) cleaner frame 81 in both the up-down direction and the front-rear direction. On the other hand, the connection portions 53 other than the foremost connection portion 53 have the screw insertion hole 56A of a generally elongated shape in the front-rear direction in a side view. Therefore, the waste toner conveyer 51 is permitted to move relative to the corresponding cleaner frames 81 in the front-rear direction, but is restricted from moving in the up-down direction relative to the corresponding cleaner frames 81.

As illustrated in FIG. 7B, the second screw 57 is disposed inside the conveying pipe 52. The second screw 57 is an auger screw that extends in the front-rear direction. That is, the second screw 57 defines a center axis A3 extending in the front-rear direction. When projected in the up-down direction, the second screw 57 overlaps the small-diameter portion 44 of the right flange member 42R and the right end portion of the neutralizing member 84 (see FIGS. 6A and 6B). Further, when projected in the left-right direction, an upper half of the second screw 57 overlaps the lower end portion of the drum body 41 of the corresponding photosensitive drum 11. The second screw 57 has a front end portion that is rotatably supported by a front wall of the conveying pipe 52, and a rear end portion that is rotatably supported by a rear wall of the conveying pipe 52. The rear end portion of the second screw 57 penetrates the rear wall of the conveying pipe 52 and protrudes rearward therefrom.

The second screw gear 58 is supported on the rear end portion of the conveying pipe 52 so as to be rotatable relative to the same. The second screw gear 58 supports the rear end portion of the second screw 57 so as not to rotate relative to the second screw 57. The second screw gear 58 has a substantially columnar shape that extends in the front-rear direction, and helical teeth are formed on an entire peripheral surface of the second screw gear 58.

The four seal members 61 are disposed to respectively correspond to the four drum cleaners 32. As illustrated in FIGS. 5 and 6B, each seal member 61 is disposed in a compressed state between the waste toner conveying portion 88 of the corresponding drum cleaner 32 and the corresponding insertion portion 54. Accordingly, each seal member 61 seals a gap between the waste toner conveying portion 88 of the corresponding drum cleaner 32 and the corresponding insertion portion 54. Each seal member 61 is formed of an elastic member such as a sponge and has a substantially rectangular flat plate-like shape in a side view. Each seal member 61 includes an insertion hole 62.

The insertion hole 62 is formed in a center region of the seal member 61 to penetrate therethrough in the left-right direction. The insertion hole 62 has a substantially elongated hole shape in a side view that extends in the front-rear direction.

(4) Rotation Member

Figure 8:
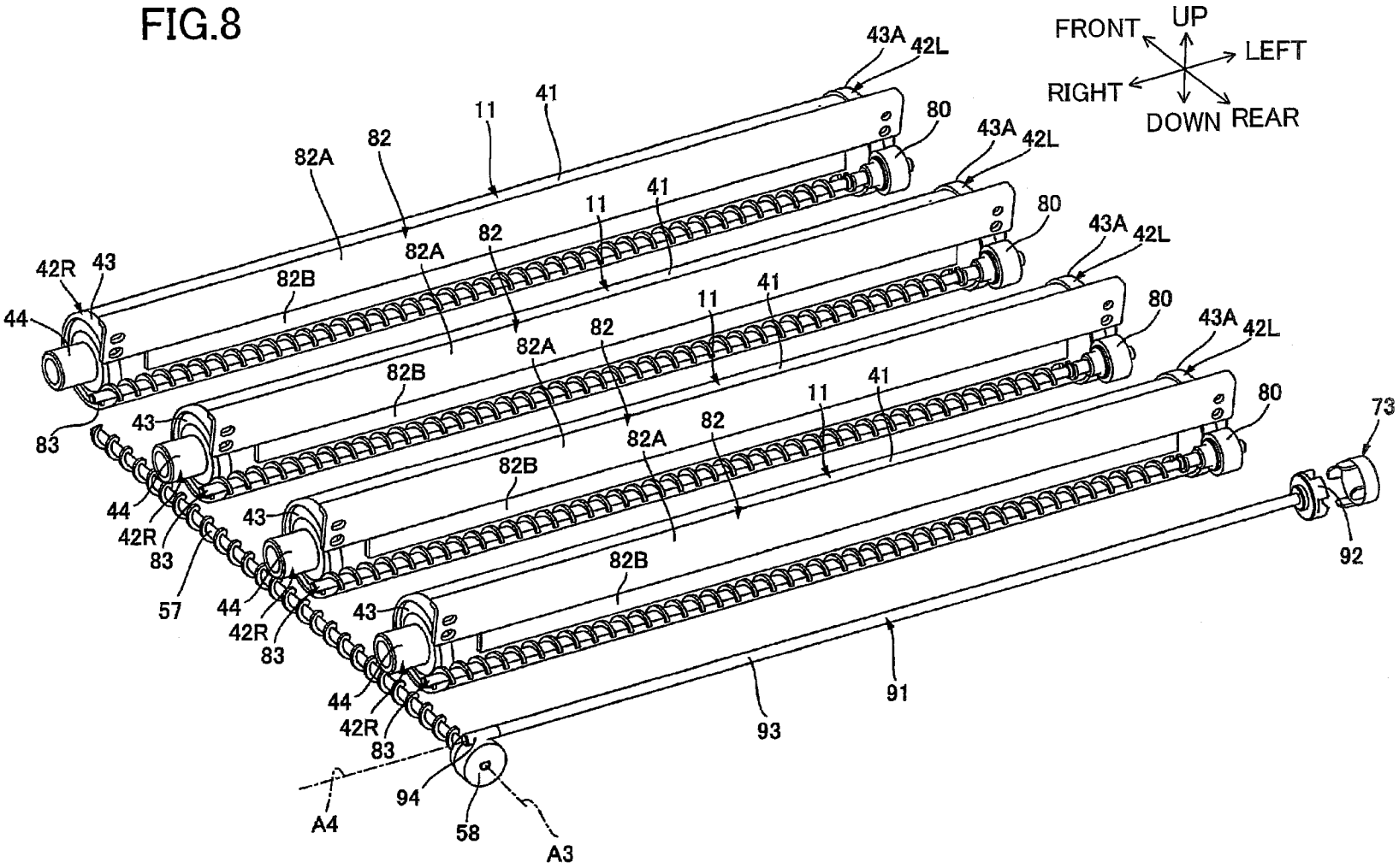
FIG. 8 is an explanatory view explaining transmission of drive force to the first screw and the second screw shown in FIG. 7B.

As illustrated in FIGS. 2 and 8, the rotation member 91 is disposed at the rear end portion of the drum unit 9. The rotation member 91 includes a drive shaft 93, a coupling member 92, and a worm gear 94.

The drive shaft 93 has a substantially columnar shape extending in the left-right direction. That is, the drive shaft 93 defines a center axis A4 extending in the left-right direction (shown in FIG. 8). The drive shaft 93 has both end portions in the left-right direction that are rotatably supported respectively by a pair of support plates 95 constituting the rearmost cleaner frame 81 (see FIGS. 2 and 3). Each support plate 95 has a substantially plate-like shape that extends rearward from each of the left and right end portions of the rearmost cleaner frame 81.

The coupling member 92 constitutes a left end portion of the rotation member 91. The coupling member 92 has a substantially columnar shape that extends in the left-right direction. The coupling member 92 shares the center axis A4 with the drive shaft 93. The coupling member 92 is supported by the left end portion of the drive shaft 93 so as not to rotate relative to the drive shaft 93. The coupling member 92 is rotatably supported within a penetration hole 36B (described later, see FIG. 3) formed in a lower-rear end portion of the left outer plate 36. That is, the coupling member 92 is positioned leftward of the drum body 41 of each of the plurality of photosensitive drums 11. The coupling member 92 is configured to be fitted to a body coupling 73 provided in the apparatus body 2 so as not to rotate relative to the body coupling 73.

The worm gear 94 constitutes a right end portion of the rotation member 91. The worm gear 94 has a substantially columnar shape that extends in the left-right direction. The worm gear 94 shares the center axis A4 together with the drive shaft 93. The worm gear 94 is supported by the right end portion of the drive shaft 93 so as not to rotate relative to the drive shaft 93. The worm gear 94 has a peripheral surface provided with screw-thread-shaped gear teeth. The worm gear 94 is configured to be engaged with an upper end portion of the second screw gear 58 (see FIG. 8).

(5) Front Plate, Rear Plate, and Outer Plates

As illustrated in FIG. 2, the front plate 34 constitutes the front end portion of the drum unit 9. The front plate 34 has a substantially rectangular flat plate-like shape that is elongated in the left-right direction in a front view. The front plate 34 is provided to span between the front end portions of the pair of inner plates 31. The front plate 34 includes a front gripping portion 34A as an example of a first grip portion of the invention.

The front gripping portion 34A is disposed at a center of the front plate 34 in the left-right direction. The front gripping portion 34A has a substantially plate-like shape that extends in the left-right direction. The front gripping portion 34A protrudes frontward from a front surface of the front plate 34.

The rear plate 35 constitutes the rear end portion of the drum unit 9. The rear plate 35 has a substantially rectangular flat plate-like shape elongated in the left-right direction in a front view. The rear plate 35 is provided to span between the rear end portions of the pair of inner plates 31. The rear plate 35 includes a rear gripping portion 35A as an example of a second grip portion of the invention.

The rear gripping portion 35A is disposed on an upper end portion of the rear plate 35. The rear gripping portion 35A protrudes forward and upward from an upper surface of the rear plate 35 and extends in the left-right direction. The rear gripping portion 35A has a substantially rectangular frame-like shape in a rear view. The rear gripping portion 35A is positioned frontward of the opening 59 of the conveying pipe 52 (see FIG. 10).

Figure 3:
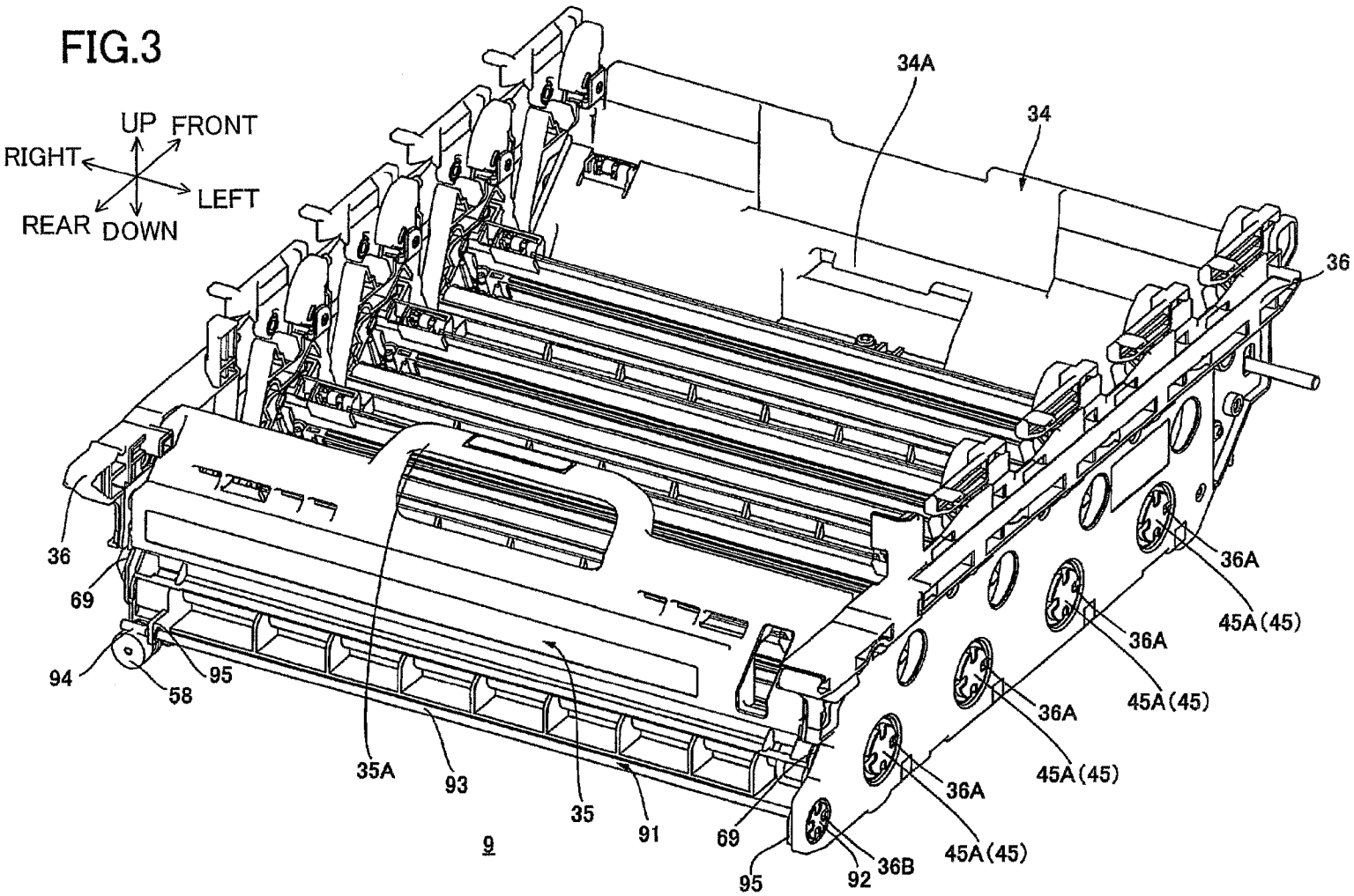
FIG. 3 is a perspective view of the drum unit according to the embodiment when viewed from leftward and rearward thereof.

The pair of outer plates 36 is disposed outside of the pair of inner plates 31 in the left-right direction. Each outer plate 36 is formed of a resin, and has a substantially rectangular flat plate-like shape in a side view. The outer plates 36 have a vertical dimension larger than that of the inner plates 31 in the up-down direction. As illustrated in FIG. 3, the left outer plate 36 includes the four penetration holes 36A and the penetration hole 36B. The coupling portions 45A of the respective drum couplings 45 are fitted to the respective penetration holes 36A such that the coupling portions 45A are rotatable within the respective penetration holes 36A. The coupling member 92 of the rotation member 91 is rotatably fitted within the penetration hole 36B. As illustrated in FIG. 6A, the left outer plate 36 faces, at a peripheral edge of each penetration holes 36A, the left surface of the flange 45B of the drum coupling 45 of each photosensitive drum 11.

3. Structure of the Apparatus Body

Figure 11A:
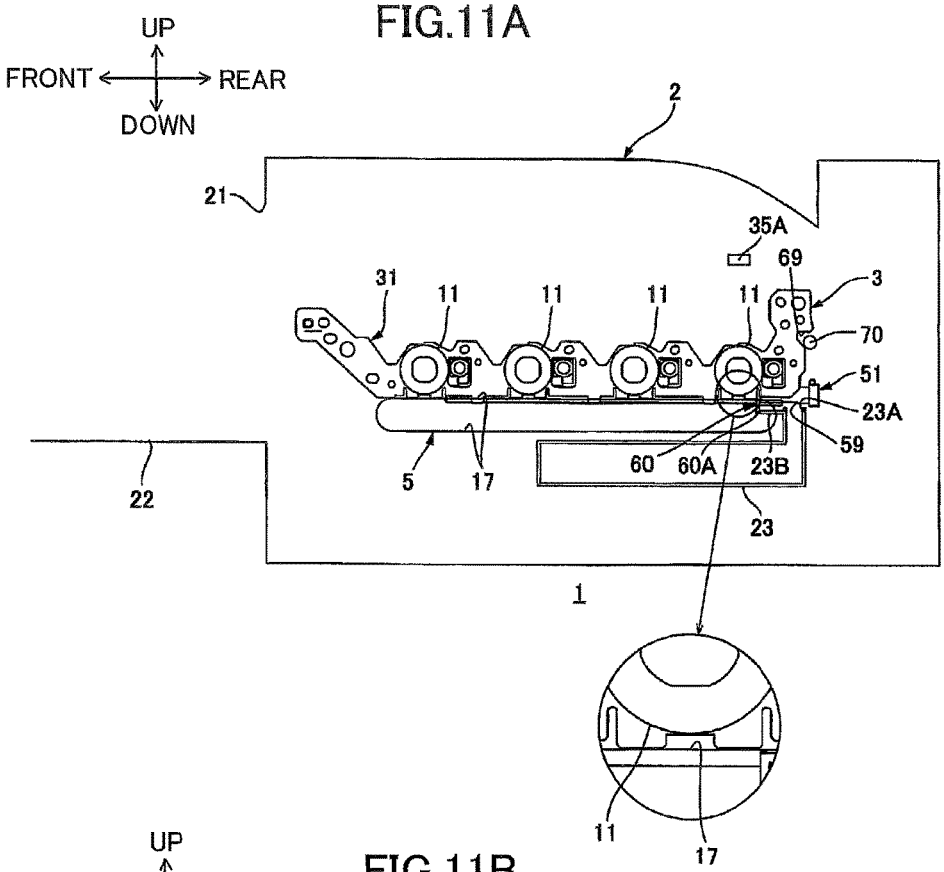
FIG. 11A is an explanatory view explaining attachment and detachment of the drum unit relative to the apparatus body of the printer according to the embodiment after the state of FIG. 10B, wherein the drum unit is in a separation position and the shutter is slightly moved from the open position toward a closed position.
Figure 11B:
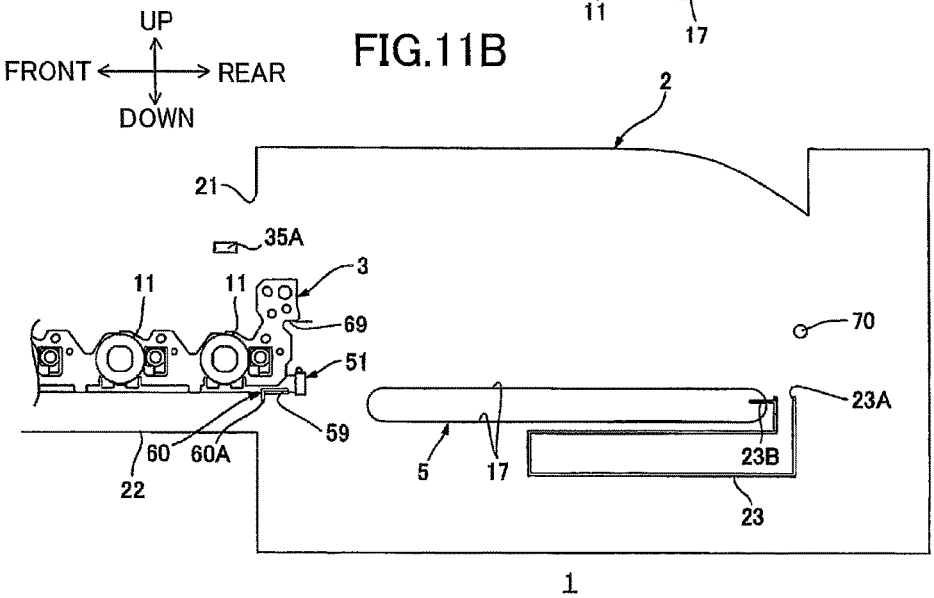
FIG. 11B is an explanatory view explaining attachment and detachment of the drum unit relative to the apparatus body of the printer according to the embodiment after the state of FIG. 11A, wherein the drum unit is in an outside position.

As illustrated in FIG. 11B, the apparatus body 2 includes a waste toner container 23 (an example of a container of the invention) and a body reference shaft 70.

The waste toner container 23 is disposed below the transfer unit 5 (see FIG. 1). The waste toner container 23 has a substantially box shape. The waste toner container 23 includes an introduction pipe 23A and an interference portion 23B as an example of a first engaging portion of the invention.

The introduction pipe 23A is disposed on a right end of a rear end portion of the waste toner container 23. The introduction pipe 23A has a substantially hollow cylindrical shape that extends in the up-down direction and defines an internal space therein. The introduction pipe 23A has an upper end portion that is open upward. The introduction pipe 23A has a lower end portion connected to the waste toner container 23 to establish communication with the waste toner container 23.

The interference portion 23B is disposed at the upper end portion of the introduction pipe 23A. The interference portion 23B has a substantially plate shape that extends forward from the upper end portion of the introduction pipe 23A.

The body reference shaft 70 is disposed in the rear end portion of the apparatus body 2. The body reference shaft 70 is provided generally above the introduction pipe 23A of the waste toner container 23. The body reference shaft 70 is formed of a metal and has a substantially columnar shape that extends in the left-right direction.

4. Attachment and Detachment of the Drum Unit

Figure 10A:
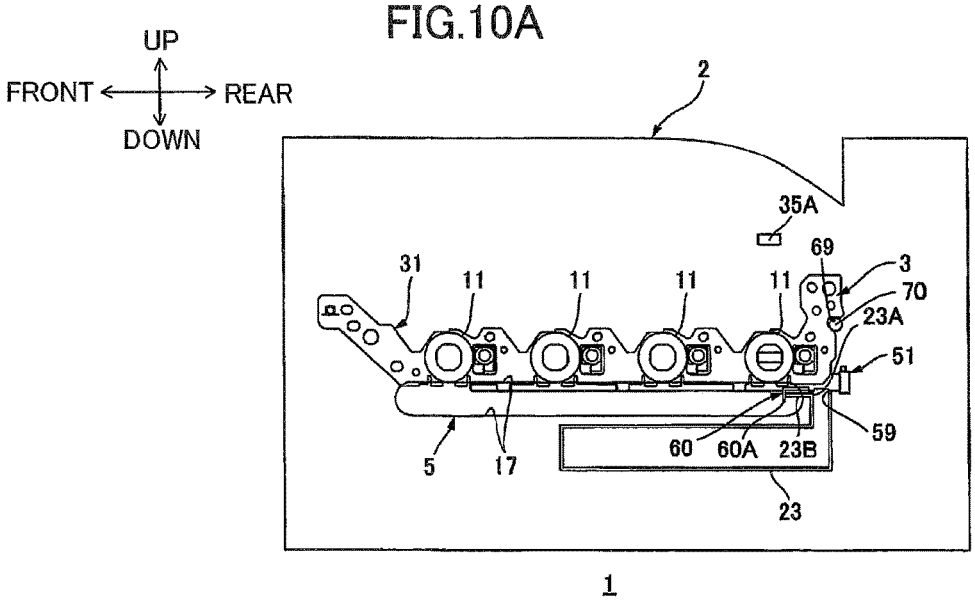
FIG. 10A is an explanatory view explaining attachment and detachment of the drum unit relative to an apparatus body of the printer according to the embodiment, wherein the drum unit is in an inside position.

When the drum unit 9 (the process unit 3) is in the inside position inside the apparatus body 2, the notch portions 69 of the right and left inner plates 31 are respectively fitted to right and left end portions of the body reference shaft 70, as illustrated in FIG. 10A. The drum unit 9 is thus fixed in position at the inside position.

At this time, each of the photosensitive drums 11 contacts the upper portion of the conveyor belt 17 (the drum unit 9 is at the contact position). The shutter 60 of the conveying pipe 52 is at the open position. The contact rib 60A of the shutter 60 contacts a front end portion of the interference portion 23B of the waste toner container 23. The conveying pipe 52 is connected to the upper end portion (open end) of the introduction pipe 23A of the waste toner container 23 such that the opening 59 of the conveying pipe 52 is aligned with the open end of the introduction pipe 23A in the up-down direction. In other words, the conveying pipe 52 is in communication with the upper end portion of the introduction pipe 23A of the waste toner container 23 through the opening 59, when the conveying pipe 52 is connected to the introduction pipe 23A.

Figure 10B:
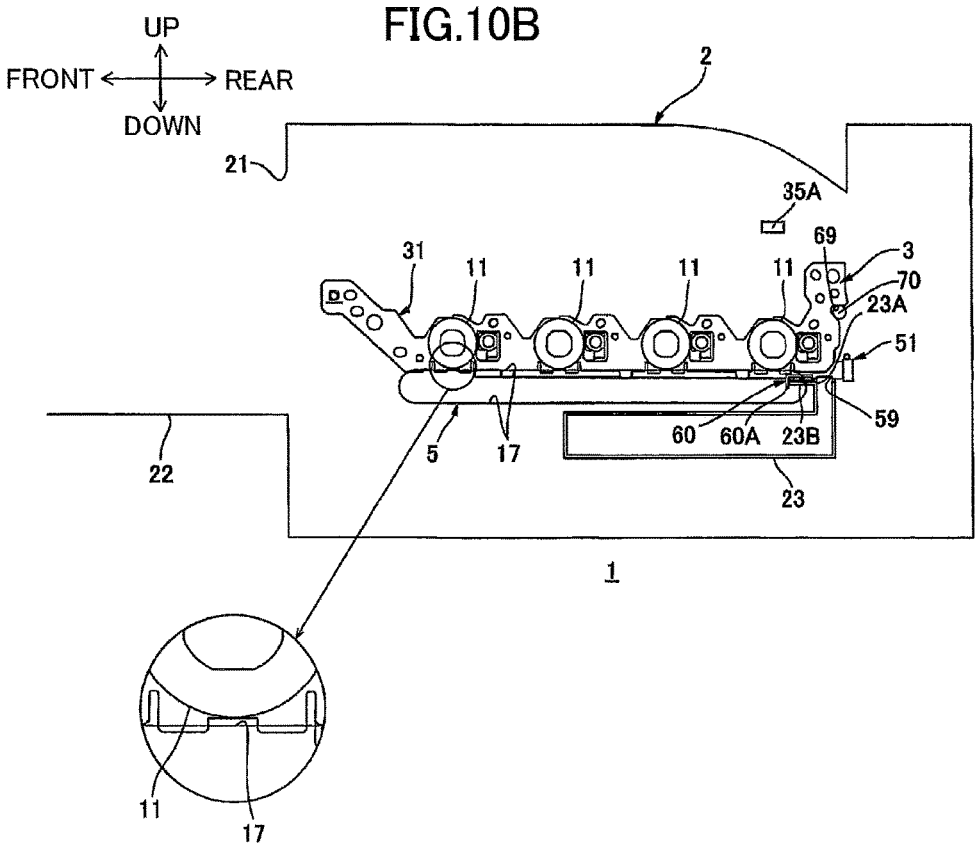
FIG. 10B is an explanatory view explaining attachment and detachment of the drum unit relative to the apparatus body of the printer according to the embodiment after the state of FIG. 10A, wherein a front cover of the apparatus body is opened and a rear end portion of the drum unit is moved slightly upward.

In order to pull out the drum unit 9 from the apparatus body 2 to bring the drum unit 9 at the outside position from the contact position, an operator first opens the front cover 22 of the apparatus body 2 as illustrated in FIG. 10B.

In conjunction with the opening of the front cover 22, the front end portion of the drum unit 9 is configured to be pressed upward by a pressing member (not illustrated). As a result, the front end portion of the drum unit 9 is slightly moved upward such that the foremost photosensitive drum 11 is slightly separated upward from the upper portion of the conveyor belt 17. That is, the drum unit 9 is inclined such that the front end portion thereof is positioned slightly higher relative to the rear end portion thereof in the up-down direction.

Subsequently, as illustrated in FIG. 11A, the operator grips the front gripping portion 34A of the drum unit 9 and pulls the drum unit 9 forward from the apparatus body 2.

The drum unit 9 is accordingly caused to move slightly forward and upward while being guided by guides (not illustrated).

In the meantime, the rear end portion of the drum unit 9 is moved, while being guided by the guides (not illustrated), forward and upward by a larger amount than the front end portion of the drum unit 9 is moved such that the rearmost photosensitive drum 11 is separated upward from the upper portion of the conveyor belt 17.

The drum unit 9 is thus placed at a separation position where all the photosensitive drums 11 are separated from the conveyor belt 17. The up-down direction corresponds to an orthogonal direction of the invention.

At this time, the drum unit 9 is supported horizontally in the apparatus body 2. The contact rib 60A of the shutter 60 and the interference portion 23B of the waste toner container 23 overlap each other when viewed in the front-rear direction. In conjunction with the frontward movement of the drum unit 9, the shutter 60 is caused to move slightly rearward toward the closed position by a biasing force of the biasing member (not illustrated) with the contact rib 60A in contact with the front end portion of the interference portion 23B of the waste toner container 23.

Subsequently, the operator pulls out the drum unit 9 further forward, while gripping the front gripping portion 34A of the drum unit 9, to move the drum unit 9 to the outside position.

This further forward movement of the drum unit 9 then causes the shutter 60 to move rearward to reach its closed position by the biasing force of the biasing member (not illustrated).

When the drum unit 9 is pulled out forward through the opening 21 until the rear gripping portion 35A is exposed, stoppers (not illustrated) provided in the apparatus body 2 restrict the drum unit 9 from moving further frontward. As illustrated in FIG. 11B, the drum unit 9 reaches the outside position.

At this time, the rear end portion of the drum unit 9 (more specifically, a portion of the drum unit 9 positioned rearward of the rear gripping portion 35A) is disposed inside the apparatus body 2. That is, the opening 59 of the conveying pipe 52 is disposed inside the apparatus body 2.

Withdrawal of the drum unit 9 from the apparatus body 2 is thus complete.

For bringing the drum unit 9 into the inside position within the apparatus body 2, the above-described operation for withdrawing the drum unit 9 is performed in reverse.

Specifically, the operator grips the front gripping portion 34A of the drum unit 9 and pushes the drum unit 9 rearward.

The drum unit 9 is accordingly caused to move backward. The direction from the front to the rear is an example of the second direction and an example of a moving direction. The contact rib 60A of the shutter 60 is brought into contact with the front end portion of the interference portion 23B of the waste toner container 23 from its front side, before the drum unit 9 reaches the separation position.

When the operator further presses the drum unit 9 rearward, the shutter 60 is caused to move forward toward the open position against the biasing force of the biasing member (not illustrated) in accordance with the rearward movement of the drum unit 9.

When the drum unit 9 is located at the separation position as illustrated in FIG. 11A, the opening 59 faces the upper end portion (open end) of the introduction pipe 23A of the waste toner container 23. At this time, the opening 59 is opened substantially entirely.

When the operator subsequently presses the drum unit 9 further rearward, the drum unit 9 moves rearward and downward while being guided by the guides (not illustrated). As a result, as illustrated in FIG. 10B, the drum unit 9 is placed at the inside position in a state where the drum unit 9 is inclined such that the front end portion thereof is positioned slightly higher than the rear end portion thereof in the up-down direction.

At this time, the shutter 60 of the conveying pipe 52 is at the open position. The opening 59 of the conveying pipe 52 is connected to the upper end portion of the introduction pipe 23A of the waste toner container 23 to provide communication between the conveying pipe 52 and the introduction pipe 23A through the opening 59.

When the operator closes the front cover 22, as illustrated in FIG. 10A, pressing of the front end portion of the drum unit 9 by the pressing member (not illustrated) is cancelled in conjunction with the closing of the front cover 22, thereby causing the front end portion of the drum unit 9 to move downward. Accordingly, all the photosensitive drums 11 are brought into contact with the upper portion of the conveyor belt 17.

Mounting of the drum unit 9 in the apparatus body 2 is thus complete.

5. Transmission of Drive Force to the First Screw and Second Screw

Upon completion of attachment of the drum unit 9 to the apparatus body 2, as illustrated in FIG. 6A, the body couplings 71 of the apparatus body 2 advance rightward in conjunction with the closing of the front cover 22, and are coupled to the drum couplings 45 of the respective photosensitive drums 11.

As illustrated in FIG. 8, the body coupling 73 of the apparatus body 2 also moves rightward, and is fitted to the coupling member 92 of the rotation member 91.

When an image forming operation is started, a drive force is inputted to the drum coupling 45 of each photosensitive drum 11 (or to the drum coupling 45 of the black photosensitive drum 11 in case of image formation in black-and-white) through the corresponding body coupling 71 of the apparatus body 2, while the drive force is also transmitted to the coupling member 92 of the rotation member 91 through the body coupling 73 of the apparatus body 2.

The photosensitive drums 11 are thus caused to rotate, and the rotation member 91 is rotated.

As the photosensitive drums 11 rotate, the drive force is transmitted to the respective first screw gears 80 via the gear parts 43A of the respective left flange members 42L. The first screw gears 80 are thus caused to rotate.

In the meantime, in accordance with rotation of the rotation member 91, the drive force is transmitted to the second screw gear 58 via the worm gear 94, thereby causing the second screw gear 58 to rotate.

6. Drum Cleaning Operation

It is conceivable that, in the image forming operation, after the toner image has been transferred onto the sheet P, toner that did not transferred onto the sheet P (residual toner) may remain on the surfaces of the photosensitive drums 11 or paper dust from the sheet P may be adhered to the surfaces of the photosensitive drums 11.

As illustrated in FIG. 7A, extraneous matter such as residual toner or paper dust is configured to be scraped off from the surfaces of the photosensitive drums 11 by the corresponding cleaning blades 82 in accordance with rotation of the photosensitive drums 11, and is configured to be accumulated in the waste toner conveying portions 88 of the corresponding drum cleaners 32.

As illustrated in FIG. 6B, the extraneous matter stored in each waste toner conveying portion 88 is then conveyed rightward by the corresponding first screw 83, and is conveyed into the corresponding insertion portion 54 of the waste toner conveyer 51.

As illustrated in FIG. 7B, the extraneous matter conveyed into the insertion portion 54 falls downward inside the corresponding communication portion 55, and is supplied into the conveying pipe 52.

The extraneous matter supplied to the conveying pipe 52 is then conveyed rearward by the second screw 57, and is finally conveyed to the waste toner container 23 through the opening 59, as illustrated in FIG. 10A.

7. Operational Advantages (1) According to the printer 1 and the drum unit 9 of the depicted embodiment, the opening 59 of the conveying pipe 52 connectable to the waste toner container 23 is formed at the rear end portion of the conveying pipe 52, as illustrated in FIG. 9B.

With this structure, as illustrated in FIG. 11B, contamination of the front end portion of the drum unit 9 can be prevented even if extraneous matter (waste toner) spills out of the opening 59 during displacement of the drum unit 9 to the outside position.

Further, as illustrated in FIG. 9A, the conveying pipe 52 is provided with the shutter 60 that is configured to open and close the opening 59. Since this shutter 60 is located at the closed position when the drum unit 9 is moved to the outside position, spilling out of the extraneous matter (waste toner) through the opening 59 can be reliably suppressed.

As a result, contamination of the front end portion of the drum unit 9 can be reliably prevented, which enables the drum unit 9 to move smoothly relative to the apparatus body 2.

(2) According to the printer 1 of the embodiment, as illustrated in FIG. 11B, the opening 59 is positioned within the apparatus body 2 in a state that the drum unit 9 is placed at the outside position.

Therefore, even if extraneous matter (waste toner) spills out of the opening 59 while the drum unit 9 is in the outside position, the extraneous matter can be prevented from spilling onto the outside of the apparatus body 2.

(3) According to the above-described printer 1, the second screw 57 (waste toner conveyer 51) is supported by the drum unit 9 as illustrated in FIG. 7B, and the waste toner container 23 is supported by the apparatus body 2 as illustrated in FIG. 11B.

Hence, the drum unit 9 can be downsized, compared to a configuration in which the waste toner container 23 is supported by the drum unit 9.

(4) According to the printer 1 and the drum unit 9 of the embodiment, the opening 59 is arranged rearward of the front gripping portion 34A as illustrated in FIGS. 1 and 10A. This construction can prevent the front gripping portion 34A from becoming dirty even when the extraneous matter spills out of the opening 59, which facilitates operator's gripping of the front gripping portion 34A.

(5) According to the printer 1 and the drum unit 9 of the embodiment, as illustrated in FIG. 10A, the opening 59 is disposed rearward of the rear gripping portion 35A. Hence, this construction can also prevent contamination of the rear gripping portion 35A. As a result, the operator can easily grip the rear gripping portion 35A.

(6) According to the printer 1 of the embodiment, as illustrated in FIGS. 9A and 9B, the shutter 60 is configured to move between the open position and the closed position with respect to a direction in which the drum unit 9 moves, that is, with respect to the front-rear direction.

With this structure, as illustrated in FIGS. 10B and 11A, the movement of the drum unit 9 and the movement of the shutter 60 can be easily made in interlocking relation to each other.

(7) According to the printer 1 of the embodiment, after the drum unit 9 is displaced at the separation position as illustrated in FIG. 11A, the drum unit 9 is made movable between the separation position and outside position while the photosensitive drums 11 do not contact the sheet P (i.e., the photosensitive drums 11 are in separation from the upper portion of the conveyor belt 17) as illustrated in FIG. 11B.

This configuration can prevent any damage to the photosensitive drums 11 attributed to rubbing against the sheet P or the conveyor belt 17 during withdrawal and/or attachment of the drum unit 9 relative to the apparatus body 2.

(8) According to the printer 1 of the embodiment, as illustrated in FIGS. 11A and 11B, the shutter 60 is configured to move from the open position toward the closed position while the drum unit 9 moves from the separation position to the outside position, and is configured to move from the closed position toward the open position while the drum unit 9 moves from the outside position to the separation position.

This structure enables the shutter 60 to move in conjunction with the movement of the drum unit 9 between the separation position and the outside position.

(9) According to the printer 1 of the depicted embodiment, as illustrated in FIG. 11A, the shutter 60 is provided with the contact rib 60A that is configured to engage the interference portion 23B of the waste toner container 23 of the apparatus body 2.

With this structure, the movement of the drum unit 9 can be made in interlocking relation to the movement of the shutter 60 through a simple configuration.

(10) According to the printer 1 of the embodiment, when the drum unit 9 is in the separation position as illustrated in FIG. 11A, the interference portion 23B of the waste toner container 23 overlaps the contact rib 60A of the shutter 60 when viewed in the front-rear direction.

With this structure, the interference portion 23B of the waste toner container 23 and the contact rib 60A of the shutter 60 can be reliably brought into contact with each other when the drum unit 9 is in the separation position.

9. Variations and Modifications (1) In the above-described embodiment, the worm gear 94 is provided at the right end portion of the rotation member 91, and the second screw gear 58 is configured as a helical gear engaging with the worm gear 94.

Figure 12:
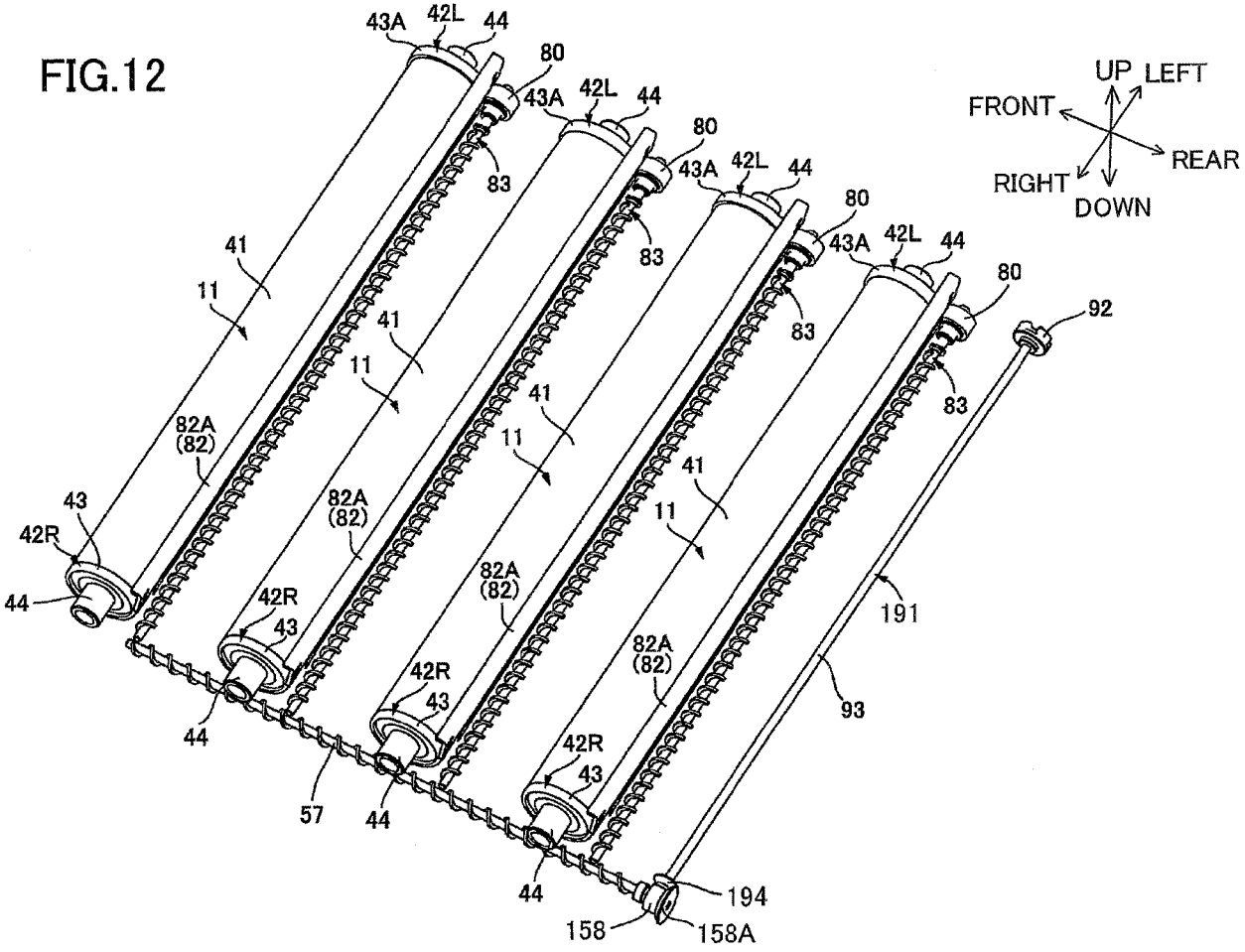
FIG. 12 shows a structure according to a first modification to the embodiment.

FIG. 12 shows a rotation member 191 according to a first modification to the embodiment. In the rotation member 191, a first bevel gear 194 is provided at the right end portion of the drive shaft 93 in place of the worm gear 94. In this first modification, a second screw gear 158 is provided on the rear end portion of the second screw 57. The second screw gear 158 includes a second bevel gear 158A that engages the first bevel gear 194.

Figure 13A:
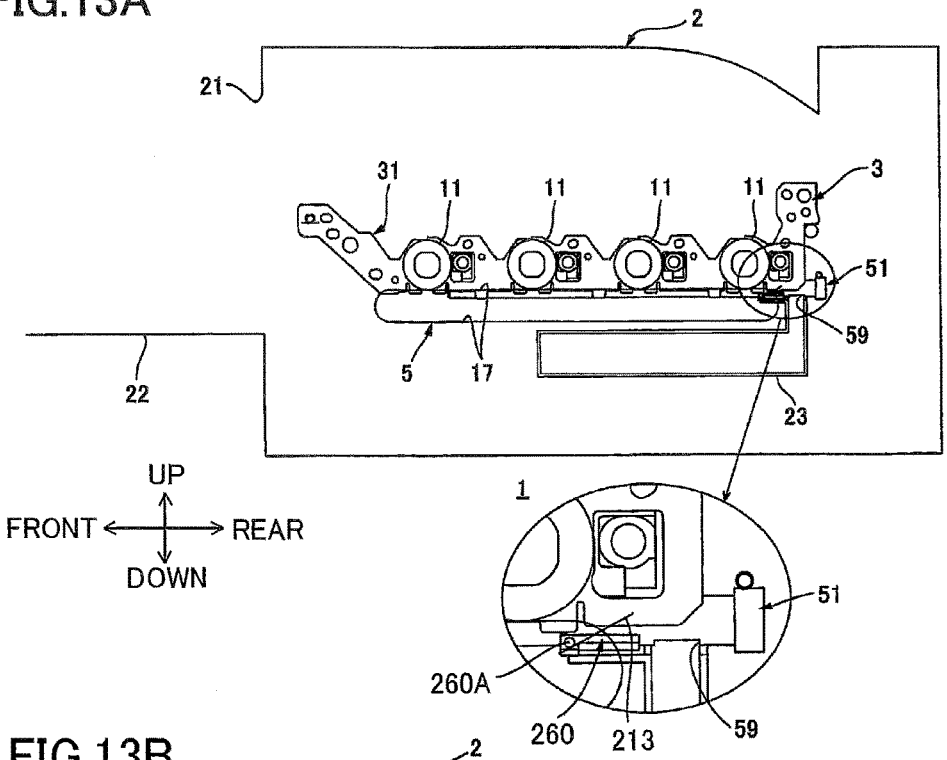
FIG. 13A is an explanatory view explaining a structure according to a second medication to the embodiment, wherein the drum unit is in the inside position and a shutter according to the second modification is in its open position.
Figure 13B:
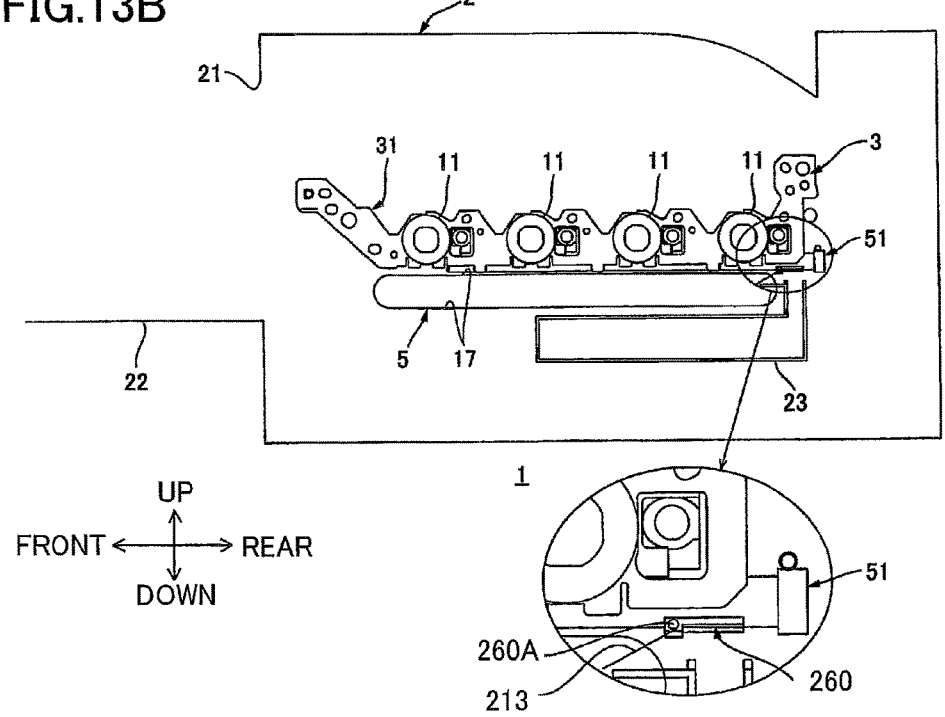
FIG. 13B is an explanatory view explaining a structure according to the second medication to the embodiment, wherein the drum unit is in the separation position and the shutter according to the second modification is in its closed position.

(2) In the above-described embodiment, while the drum unit 9 is in the separation position, the shutter 60 is disposed at a position slightly moving to the closed position from the open position. As a variation, FIGS. 13A and 13B show a structure according to a second modification of the embodiment. In the second modification, a shutter 260 is provided instead of the shutter 60. The shutter 260 is configured to be placed in the closed position while the drum unit 9 is at the separation position.

Specifically, the shutter 260 is provided with a substantially columnar boss 260A as another example of the second engaging portion of the invention. The boss 260A protrudes rightward from a front end of a right end portion of the shutter 260. A sloped rib 213 as another example of the first engaging portion of the invention is provided in the right end portion of the apparatus body 2 so as to engage with the boss 260A.

When the drum unit 9 is at the inside position (contact position), as illustrated in FIG. 13A, the boss 260A is in contact with a lower end portion of the inclined rib 213, and hence the shutter 260 is placed at the open position.

When the drum unit 9 is moved upward from the inside position (contact position) to be displaced at the separation position, as illustrated in FIG. 13B, the shutter 260 is configured to move from the open position toward the closed position while the boss 260A slides rearward and upward along the slope of the sloped rib 213 by a biasing force of a biasing member (not illustrated).

Figure 14:
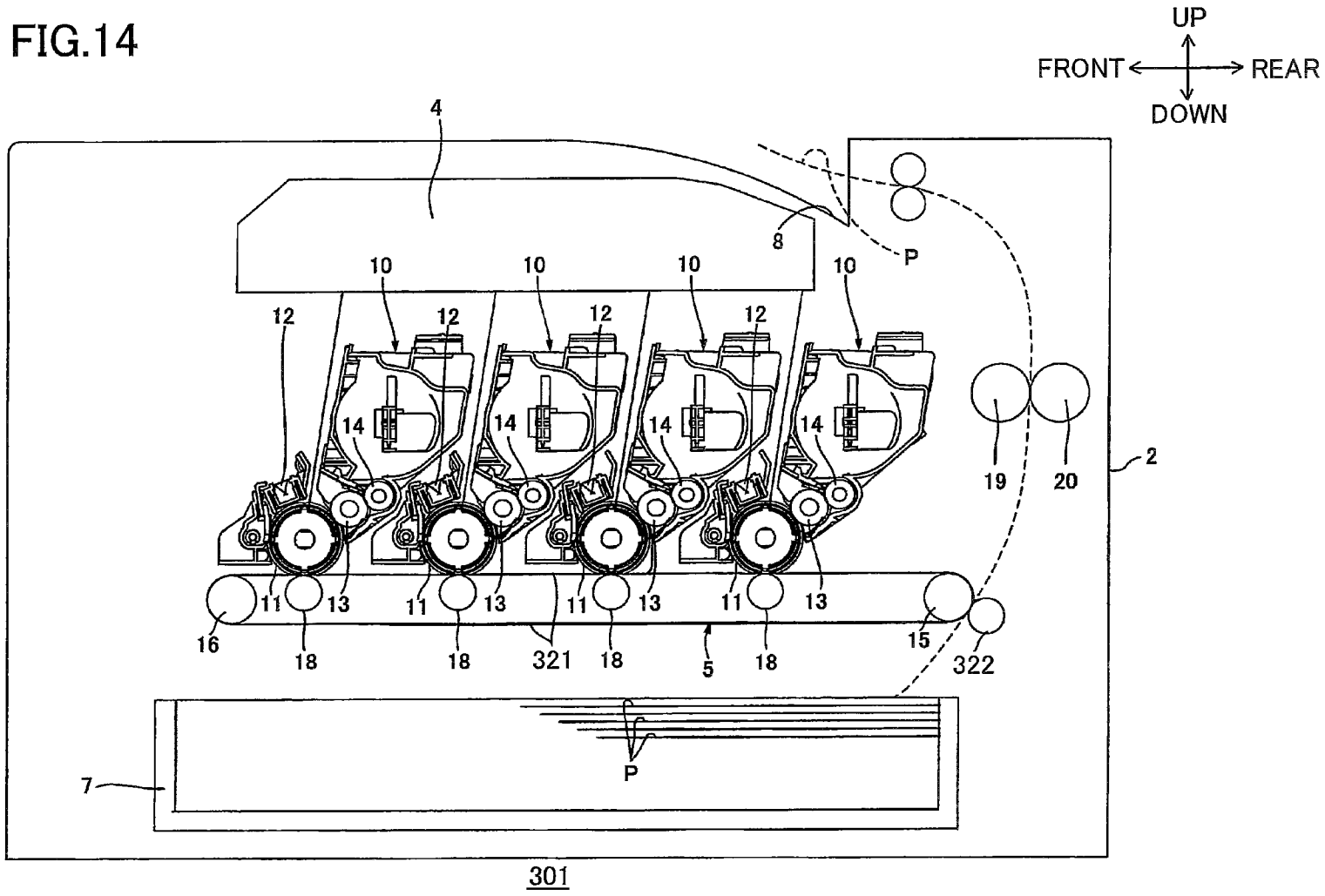
FIG. 14 is a vertical cross-sectional view of an intermediate transfer-type printer as an example of an image forming apparatus according to a third modification to the embodiment.

(3) In the above-described embodiment, the image forming apparatus of the invention is configured as a direct tandem-type color laser printer 1 as an example. However, the image forming apparatus of the invention may be configured as an intermediate transfer-type color printer. FIG. 14 shows an intermediate transfer-type color printer 301 according to a third modification to the embodiment. The color printer 301 includes an intermediate transfer belt 321 and a secondary transfer roller 322.

In this case, the intermediate transfer belt 321 is configured to circularly move such that an upper portion thereof moves from the rear side to the front side during image forming operations.

A toner image borne on the surface of each photosensitive drum 11 is first transferred onto the upper portion of the intermediate transfer belt 321, is then conveyed frontward while passing below the transfer rollers 18 in accordance with the circular movement of the intermediate transfer belt 321, and is supplied between the drive roller 15 and the secondary transfer roller 322.

Meanwhile, the sheet P is conveyed rearward and upward from the sheet feeding tray 7, and is fed between the drive roller 15 and the secondary transfer roller 322 at a predetermined timing, whereby the toner image on the intermediate transfer belt 321 is transferred onto the sheet P.

While the sheet P subsequently passes between the heating roller 19 and the pressing roller 20, the toner image on the sheet P is thermally-fixed to the sheet P. The image-formed sheet P is finally discharged to the sheet discharge tray 8.

(4) In the above-described embodiment, the shutter 60 is configured to be displaced to the closed position while the drum unit 9 reaching the separation position moves from the separation position to the outside position. However, alternatively, the drum unit 9 may be first displaced slightly frontward to move the shutter 60 to the closed position, and then displaced to the separation position and subsequently moved from the separation position to the outside position.

(5) In the above-described embodiment, the inner plates 31 support the small-diameter portions 44 of the flange members 42 of the respective photosensitive drums 11. However, the inner plates 31 may be configured to support a plurality of drum shafts each penetrating the center of each photosensitive drum 11 instead of the small-diameter portions 44.

(6) In the above-described embodiment, the conveying pipe 52 extends in the front-rear direction. Alternatively, the conveying pipe 52 may extend in a direction sloping relative to the front-rear direction. Specifically, the conveying pipe 52 may be arranged to incline such that the rear end portion thereof is positioned lower than the front end portion thereof.

(7) In the above-described embodiment, auger screws are exemplified as the first conveyer and the second conveyer of the invention. But the first conveyer and the second conveyer may instead be configured as screws formed of a spiral-shaped spring members.

(8) Although the plate-shaped cleaning blade 82 extending in the left-right direction is exemplified as the cleaner in the above-described embodiment, a substantially columnar-shaped cleaning roller extending in the left-right direction may be employed as the cleaner, for example.

In these modifications and variations (1)-(8) mentioned above, the same operational and technical advantages as the depicted embodiment can be obtained.

While the invention has been described in detail with reference to the specific embodiment thereof, it would be apparent to those skilled in the art that various changes and modifications may be made therein without departing from the scope of the invention.

What is claimed is:

1. An image forming apparatus comprising:

an apparatus body having an opening;

a first photosensitive drum defining an axis extending in a first direction;

a second photosensitive drum defining an axis extending in the first direction;

a support member configured to move through the opening between an inside position where the support member is inside the apparatus body and an outside position where the support member is outside the apparatus body, a second direction being defined as a direction in which the support member moves from the outside position toward the inside position, the second direction intersecting with the first direction, the second photosensitive drum being positioned farther away from the opening than the first photosensitive drum is from the opening in the second direction;

a first cleaner configured to remove waste toner from the first photosensitive drum;

a second cleaner configured to remove waste toner from the second photosensitive drum;

a first conveyer configured to convey the waste toner removed by the first cleaner in the first direction;

a second conveyer configured to convey the waste toner removed by the second cleaner in the first direction;

a conveying unit comprising:

a third conveyer configured to convey the waste toner conveyed by the first conveyer and the second conveyer in the second direction; and a conveying pipe accommodating the third conveyer therein, the conveying pipe extending in the second direction and being formed with a conveyer-side opening at a position downstream relative to the second photosensitive drum in the second direction, the conveying pipe including a shutter configured to move between an open position where the shutter opens the conveyer-side opening and a closed position where the shutter closes the conveyer-side opening; and a container configured to store the waste toner conveyed by the third conveyer, the conveying pipe being connectable to and removable from the container, the conveying pipe being connectable to the container through the conveyer-side opening.

2. The image forming apparatus as claimed in claim 1, wherein the conveying unit is supported on the support member, the conveyer-side opening being disposed within the apparatus body when the support member is in the outside position.

3. The image forming apparatus as claimed in claim 1, wherein the conveying unit is supported on the support member, and wherein the container is supported by the apparatus body.

4. The image forming apparatus as claimed in claim 1, wherein the support member has an upstream end portion in the second direction, the upstream end portion being provided with a first grip portion, and wherein the conveyer-side opening is positioned downstream of the first grip portion in the second direction.

5. The image forming apparatus as claimed in claim 4, wherein the support member has a downstream end portion in the second direction, the downstream end portion being provided with a second grip portion, and wherein the conveyer-side opening is positioned downstream of the second grip portion in the second direction.

6. The image forming apparatus as claimed in claim 1, wherein the shutter is biased toward the closed position and is configured to move between the open position and the closed position in interlocking relation to the movement of the support member.

7. The image forming apparatus as claimed in claim 1, wherein the first direction is perpendicular to the second direction.

8. The image forming apparatus as claimed in claim 7, wherein the first photosensitive drum and the second photosensitive drum are supported by the support member and are configured to contact a transfer medium, wherein the support member at the inside position is further configured to move between a contact position and a separation position in an orthogonal direction orthogonal to the first direction and the second direction, the first photosensitive drum and the second photosensitive drum supported by the support member at the contact position being in contact with the transfer medium, the first photosensitive drum and the second photosensitive drum supported by the support member at the separation position being in separation from the transfer medium, and wherein the outside position is displaced from the separation position in the second direction.

9. The image forming apparatus as claimed in claim 8, wherein the shutter is configured to move from the open position toward the closed position in conjunction with the movement of the support member from the separation position to the outside position, and wherein the shutter is configured to move from the closed position toward the open position in conjunction with the movement of the support member from the outside position to the separation position.

10. The image forming apparatus as claimed in claim 9, wherein the apparatus body includes a first engaging portion, and wherein the shutter includes a second engaging portion configured to engage the first engaging portion, engagement of the second engaging portion and the first engaging portion causing the shutter to move:

from the closed position to the open position in conjunction with the movement of the support member from the outside position in the second direction; and from the open position to the closed position in conjunction with the movement of the support member from the inside position to the outside position.

11. The image forming apparatus as claimed in claim 10, wherein, when the support member is in the separation position, the first engaging portion and the second engaging portion are overlapped with each other when viewed in the second direction.

12. The image forming apparatus as claimed in claim 10, wherein the shutter has a downstream end in the second direction, and wherein the second engaging portion is a rib protruding from the downstream end of the shutter.

13. The image forming apparatus as claimed in claim 10, wherein the first engaging portion is a plate extending in the second direction.

14. The image forming apparatus as claimed in claim 8, wherein the shutter is biased toward the closed position and is configured to move between the open position and the closed position in interlocking relation to the movement of the support member between the contact position and the separation position.

15. The image forming apparatus as claimed in claim 14, wherein the apparatus body includes a first engaging portion, and wherein the shutter includes a second engaging portion configured to engage the first engaging portion, the shutter being biased toward the closed position, engagement of the second engaging portion and the first engaging portion causing the shutter to move:

from the closed position to the open position in conjunction with the movement of the support member from the separation position to the contact position in the orthogonal direction; and from the open position to the closed position in conjunction with the movement of the support member from the contact position to the separation position in the orthogonal direction.

16. The image forming apparatus as claimed in claim 1, wherein the first photosensitive drum and the second photosensitive drum are supported by the support member and are configured to contact a transfer medium when the supported member is at the inside position, wherein the support member is further configured to move between a first position and a second position in an orthogonal direction orthogonal to the first direction and the second direction, the first position being displaced toward the outside position from the inside position in the second direction, the shutter being in the closed position when the support member is at the first position, the second position being displaced from the first position in the orthogonal direction and in a separation direction permitting the photosensitive drum to move away from the transfer medium, and wherein the support member in the inside position is configured to move to the first position and then to the second position to reach the outside position.

17. The image forming apparatus as claimed in claim 1, wherein the first conveyer is an auger and the second conveyer is an auger, and wherein the third conveyer is an auger.

18. The image forming apparatus as claimed in claim 1, wherein the first cleaner is a blade and the second cleaner is a blade.

19. An image forming apparatus comprising:

an apparatus body having an opening;

a first photosensitive drum defining an axis extending in a first direction;

a second photosensitive drum defining an axis extending in the first direction;

a support member supporting the first photosensitive drum and the second photosensitive drum, the support member being configured to move through the opening between an inside position where the support member is inside the apparatus body and an outside position where the support member is outside the apparatus body, a second direction being defined as a direction in which the support member moves from the outside position toward the inside position, the second direction intersecting with the first direction, the second photosensitive drum being positioned farther away from the opening than the first photosensitive drum is from the opening in the second direction;

a first cleaner supported on the support member and configured to remove waste toner from the first photosensitive drum;

a second cleaner supported on the support member and configured to remove waste toner from the second photosensitive drum;

a first conveyer supported on the support member and configured to convey the waste toner removed by the first cleaner in the first direction;

a second conveyer supported on the support member and configured to convey the waste toner removed by the second cleaner in the first direction;

a third conveyer supported on the support member and configured to convey the waste toner conveyed by the first conveyer and the second conveyer in the second direction, the third conveyer extending in the second direction and being formed with a conveyer-side opening at a position downstream relative to the second photosensitive drum in the second direction, the third conveyer including a shutter configured to move between an open position where the shutter opens the conveyer-side opening and a closed position where the shutter closes the conveyer-side opening; and a container supported by the apparatus body and configured to store the waste toner conveyed by the third conveyer, the third conveyer being connectable to and removable from the container in accordance with movement of the support member between the inside position and the outside position, the third conveyer being connectable to the container through the conveyer-side opening.

20. The image forming apparatus as claimed in claim 19, wherein the third conveyer comprises:

a conveying member configured to convey the waste toner conveyed by the first conveyer and the second conveyer in the second direction; and a conveying pipe accommodating the conveying member therein, the conveyer-side opening being formed in the conveying pipe.

* * * * *